US007832981B2

(12) United States Patent
Hasan et al.

(10) Patent No.: US 7,832,981 B2
(45) Date of Patent: Nov. 16, 2010

(54) STATOR VANE HAVING BOTH CHORDWISE AND SPANWISE CAMBER

(75) Inventors: Atif Hasan, Rochester Hills, MI (US); John R. Savage, Rochester Hills, MI (US)

(73) Assignee: Valeo, Inc., Auburn Hills, MI (US)

( * ) Notice: Subject to any disclaimer, the term of this patent is extended or adjusted under 35 U.S.C. 154(b) by 136 days.

(21) Appl. No.: 11/380,791

(22) Filed: Apr. 28, 2006

(65) Prior Publication Data

US 2007/0253808 A1 Nov. 1, 2007

(51) Int. Cl.
*F04D 29/54* (2006.01)

(52) U.S. Cl. ..... 415/119; 415/208.2; 415/210.1; 415/211.2; 417/354; 417/423.15; 123/41.66

(58) Field of Classification Search ..... 415/119, 415/191, 192, 208.2, 209.4, 210.1, 211.2; 416/169 A; 417/352–354, 423.15; 123/41.49, 123/41.65, 41.66

See application file for complete search history.

(56) References Cited

U.S. PATENT DOCUMENTS

| | | | | |
|---|---|---|---|---|
| 2,154,313 | A | 4/1939 | McMahan | |
| 4,548,548 | A | 10/1985 | Gray, III | |
| 4,761,115 | A * | 8/1988 | Hopfensperger | 415/119 |
| 4,969,421 | A | 11/1990 | Haner et al. | |
| 5,342,167 | A | 8/1994 | Rosseau | |
| 5,460,485 | A | 10/1995 | Sugiyama et al. | |
| 5,466,120 | A | 11/1995 | Takeuchi et al. | |
| 5,577,888 | A | 11/1996 | Capdevila et al. | |
| 6,024,536 | A * | 2/2000 | Tsubakida et al. | 416/189 |
| 6,045,327 | A * | 4/2000 | Amr | 415/211.2 |
| 6,139,265 | A * | 10/2000 | Alizadeh | 415/208.1 |

FOREIGN PATENT DOCUMENTS

| | | |
|---|---|---|
| DE | 4105378 | 8/1992 |
| DE | 4228879 | 3/1994 |
| DE | 19948074 | 4/2000 |
| DE | 10041805 | 6/2002 |
| EP | 1312754 | 5/2003 |
| FR | 1499693 | 10/1967 |
| FR | 2784423 | 4/2000 |
| GB | 1116580 | 6/1968 |
| GB | 2344619 | 6/2000 |

* cited by examiner

*Primary Examiner*—Christopher Verdier
(74) *Attorney, Agent, or Firm*—Jacox, Meckstroth & Jenkins

(57) ABSTRACT

A support system for a cooling fan for a heat exchanger. A suspension system supports an inner hub inside an outer support structure. The inner hub or ring supports the fan and motor. The suspension system includes an array of spiral support arms, extending from the inner hub to the outer supports. These arms have both spanwise and chordwise camber. The particular suspension system increases natural frequencies of the support system, over that wherein purely radial arms connect the inner hub and outer supports.

11 Claims, 25 Drawing Sheets

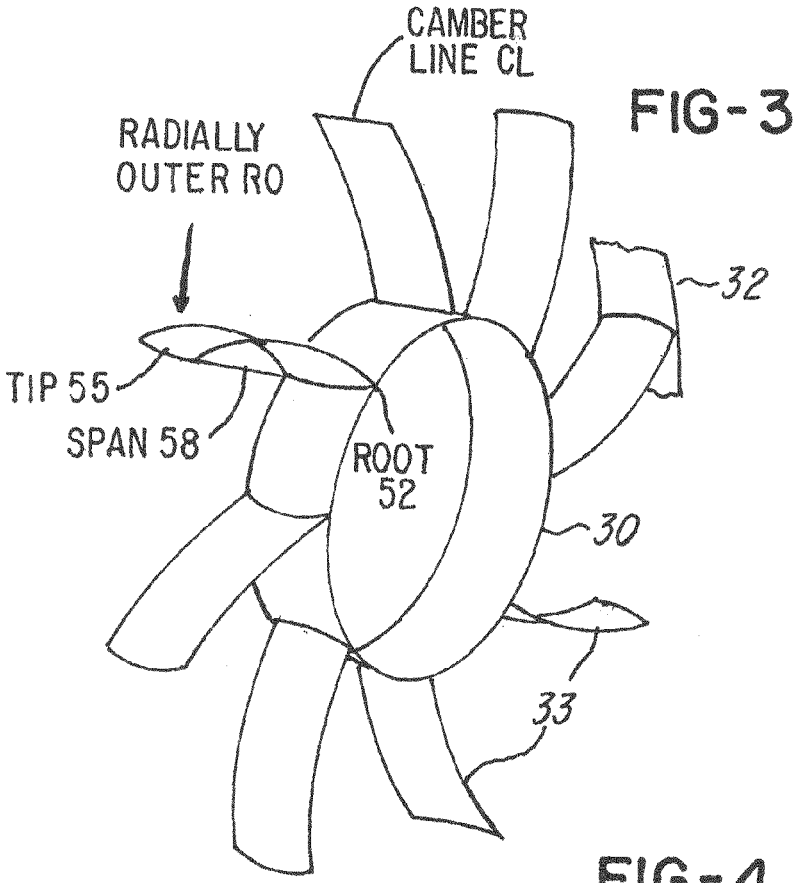
FIG-3
FIG-4
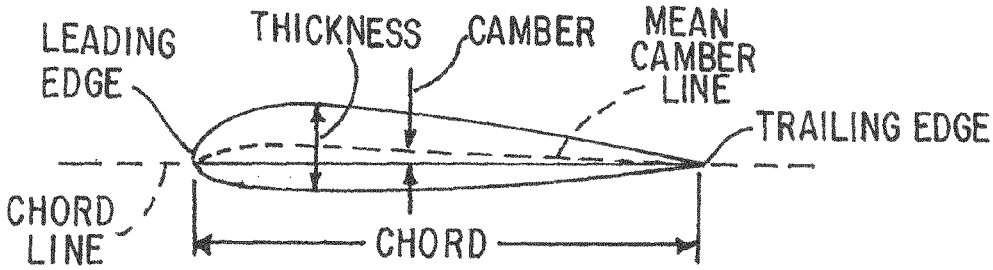
FIG-19
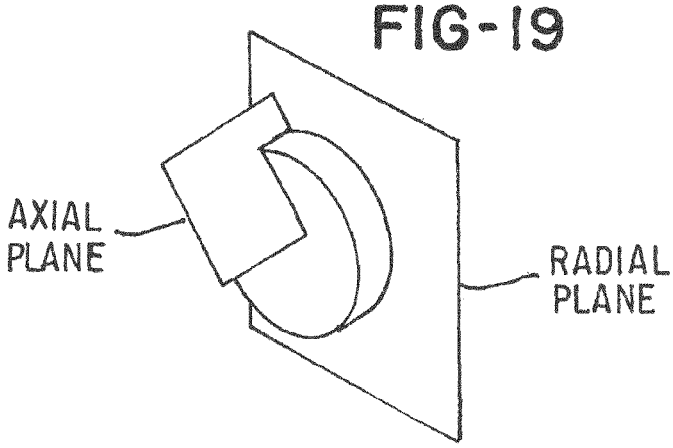

FIG. 14

| | Mode Shape | Frequency (Hz) | | % Change in Frequency | % Change in Global Stiffness |
|---|---|---|---|---|---|
| | | Baseline (Radial) | Swept | | |
| L1 | In-phase bending + twisting | 30.8 | 36.1 | +17% | +37% |
| L2 | Twisting | 70.4 | 107.3 | +52% | +230% |
| | Out-of-phase bending (1) | 74.2 | 66.8 | -10% | -19% |

C1 C2 C3 C4

FIG. 15

| | Load Case | Axial Deflection (mm) | | | In-Plane Deflection (mm) | | | Von Mises Stress (MPa) | | |
|---|---|---|---|---|---|---|---|---|---|---|
| | | Radial | Swept | %Change | Radial | Swept | % Change | Radial | Swept | % Change |
| L10 | Force = -100N | -1.022 | -1.014 | -1% | 0.657 | 0.320 | -51% | 15.2 | 12.9 | -15% |
| L11 | Moment = 6000N*mm | -0.560 | -0.058 | -90% | 0.903 | 0.143 | -85% | 10.2 | 6.4 | -37% |

B1 B2 B3

STATOR VANE HAVING BOTH CHORDWISE AND SPANWISE CAMBER

The invention concerns stator vanes which support a cooling fan motor, such as in an automotive application. The stator vanes have cambered airfoil cross sections and also have camber along their lengths, or spans.

BACKGROUND OF THE INVENTION

FIG. 1 is a simplified cross-sectional schematic drawing of a cooling fan. Ring 3, also shown in FIG. 2, supports an array of radial stator vanes 6, shown in both Figures. Ring 3 is anchored to an external support (not shown). Stator vanes 6 in FIG. 1 support an inner ring 9, which is also shown in FIG. 2. It should be understood that the structure identified as ring 9 does not have to take the form of a ring or a complete cylindrical 360° body of revolution. Inner ring 9 in FIG. 1 supports a motor, diagrammatically indicated as motor 12, which may be an electric or hydraulic motor. Motor 12 drives fan blades 15, which are supported by bearings 18.

Ideally, inner ring 9 acts as a perfectly rigid support for the motor 12. However, in practice, this ideal is not attained, and the motor 12 and the inner ring 9 can move in an axial or tangential fashion, which is not desired.

Further, a given fan system will possess certain natural or resonant frequencies. If an excitation occurs at these frequencies, as when the fan is attached to an automotive engine and the engine vibrates at such frequencies, the fan system will sympathetically vibrate at these frequencies. In general, such sympathetic vibration is not desired. A sympathetic vibration of the fan system can be the source of objectionable noise or vibration that can be noticed within the passenger compartment.

SUMMARY OF THE INVENTION

An object of the invention is to provide an improved fan mounting system.

In one form of the invention, a motor support is carried by an array of spiral arms, each arm being concave on its radially outer side.

In one aspect, this invention comprises a fan, comprising a ring which supports a fan motor which drives fan blades, and stator vanes which support the ring, and which re-direct exhaust of the fan blades, the stator vanes having a chordwise camber and a spanwise camber that is in an opposite direction than a direction of the chordwise camber, wherein the spanwise camber is concave in a counter-clockwise direction.

In another aspect, this invention comprises a motor vehicle comprising a cooling fan rotatably driven by a motor, the cooling fan comprising a support which carries a motor which drives fan blades and stators coupled to the support, the stators being chordwise concave on a first side and are spanwise concave on a second side, wherein the spanwise concaving and chordwise concaving are in opposite directions, with the spanwise concaving being substantially the same as a direction of rotation of the cooling fan.

In yet another aspect, this invention comprises an apparatus comprising a base effective to support a fan motor, a plurality of supports extending from the base, the plurality of supports each redirecting exhaust of a fan and increasing natural frequency of the base-support combination in at least one mode of vibration, compared to a second base-support combination comprising a plurality of radial supports, wherein each of the plurality of supports comprises a spanwise camber and a chordwise camber that are directed in opposite directions, with the spanwise camber being generally the same as a direction of rotation of the fan.

In still another aspect, this invention comprises a fan assembly comprising a base for supporting a fan motor that rotatably drives a fan, and a plurality of stator vanes extending from the base, each of the plurality of stator vanes having at least two sides, both sides being generally arcuate in cross section in opposite directions, with a first side defining a chordwise camber and a second side defining a spanwise camber, wherein the chordwise camber and the spanwise camber are in opposite directions with the spanwise camber direction being in a common direction of the rotation of the fan.

While the form of apparatus herein described constitutes a preferred embodiment of this invention, it is to be understood that the invention is not limited to this precise form of apparatus, and that changes may be made therein without departing from the scope of the invention which is defined in the appended claims.

BRIEF DESCRIPTION OF THE DRAWINGS

FIG. 3 is a simplified perspective view of one form of the invention;

FIG. 4 illustrates conventional terminology used to describe airfoils in the prior art;

FIGS. 14 and 15 are summaries of results of finite element analyses;

FIG. 19 illustrates reference directions in a cylindrical coordinate system;

DETAILED DESCRIPTION OF THE INVENTION

Figure 2:
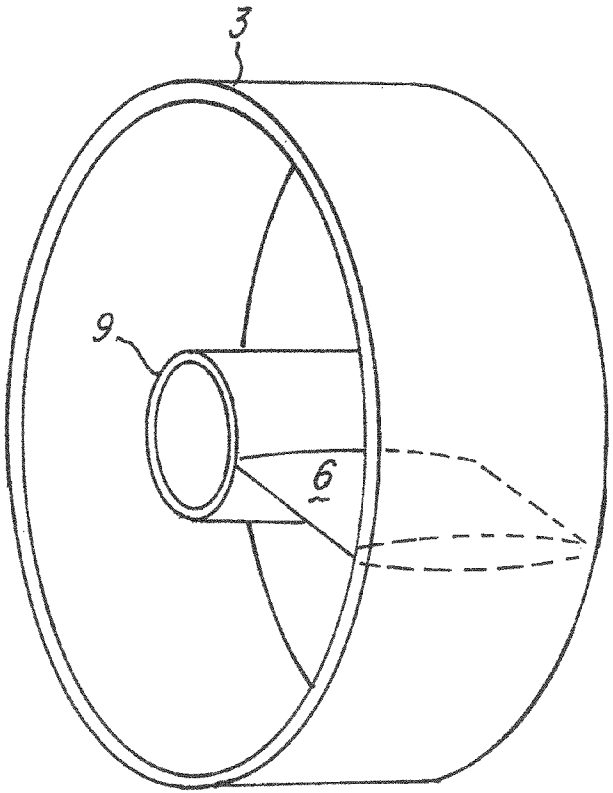
FIG-2 (PRIOR ART)
FIG. 2 is a perspective view of rings 3 and 6 of FIG. 1.
Figure 1:
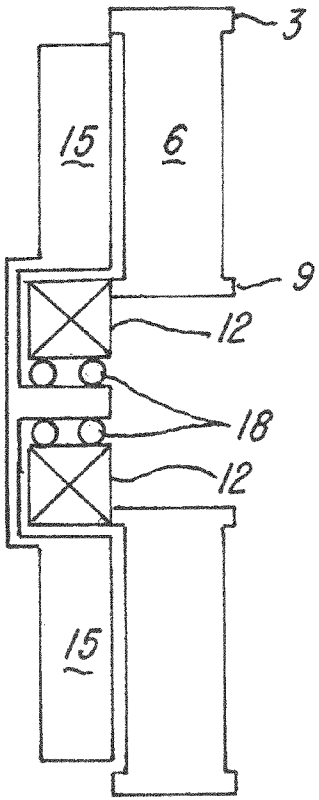
FIG-1 (PRIOR ART)
FIG. 1 is a simplified cross-sectional schematic of a prior-art cooling fan.

FIG. 3 is a simplified rendition of one form of the invention, showing a motor mount ring 30, which is analogous in function to inner mounting ring 9 in FIGS. 1 and 2. In FIG. 3, stator vanes 33 are attached to the inner ring 9, and also to an outer ring, or individual support members shown as element 32, which is analogous in function to outer ring 3 in FIGS. 1 and 2.

In FIG. 3, the stator vanes 33 are constructed with two types of camber. Camber generally is illustrated in FIG. 4, which illustrates a cross-sectional view of an airfoil. The mean camber line is the line which is midway between the lower and upper surfaces, with the distance being measured perpendicular to the mean camber line. The forwardmost point of the airfoil is the leading edge, and the rearmost point is the trailing edge, as indicated.

The straight line connecting the leading edge and the trailing edge is the chord line. The camber is the maximum distance between the mean camber line and the chord line, as indicated. This type of camber will be called chordwise camber because it is measured with respect to, or along, the chord of the airfoil.

In FIG. 3, the vanes 33 are shown by wireframe representations of the mean camber lines of the vanes 33: the vanes 33 are illustrated as having no thickness, and the cross-sections of the vanes are not shown for ease of illustration. Nevertheless, it is understood that the vanes 33 are three-dimensional airfoils. Therefore, one feature of the stator vanes 33 is that they possess chordwise camber.

A second feature is that the stator vanes 33 have spanwise camber. That is, a span line 58 is defined as the straight line running from the root 52 to the tip 55 of the stator vane 33. Spanwise camber is a distance, measured perpendicular to the span line 58, from the span line 58 to the camber line CL, shown in wire frame. Alternately, spanwise camber can be termed a distance from the span line 58 to the surface (not shown) of the stator vane 33.

A third feature is that the concavities of the two cambers are in opposite directions. That is, on the one hand, the concavity of the chordwise camber faces clockwise. For example, the vane 33 at approximately the 3 o'clock position, as viewed in FIG. 3, is concave downward. That direction is clockwise from the vane 33.

On the other hand, the concavity of the spanwise camber faces counter-clockwise. For example, the spanwise concavity of the same blade at the 3 o'clock position is concave upward. That direction is counterclockwise from the vane 33.

From another perspective, the vanes 33 in FIG. 3 are chordwise concave because they are concave along a chord. Also, the vanes 33 are spanwise concave, because they are concave along the span line 58.

From another perspective, in considering the vanes 33 as airfoils, the pressure side (that is, the bottom side in FIG. 4) has a surface running from the leading edge to the trailing edge. That surface in FIG. 3 is concave, and the concavity is bounded by the leading and trailing edges.

From another perspective, the vanes 33 in FIG. 3 collectively form an array of spiral arms, extending between the inner ring 30 and outer ring 3. The arms are concave on their radially outer, RO, sides, as indicated in the Figure.

Figure 20:
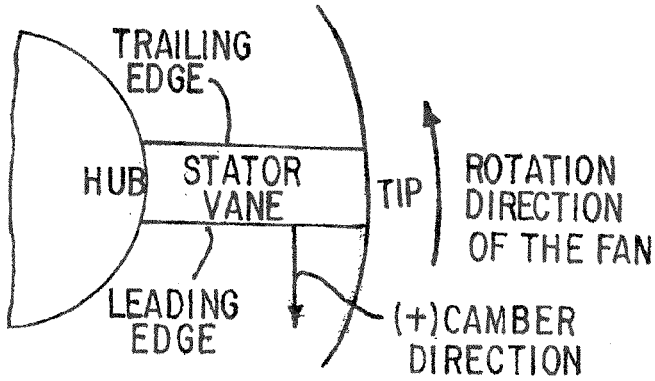
FIGS. 20-23 illustrate various references or definitions for spanwise or chordwise camber direction.
Figure 21:
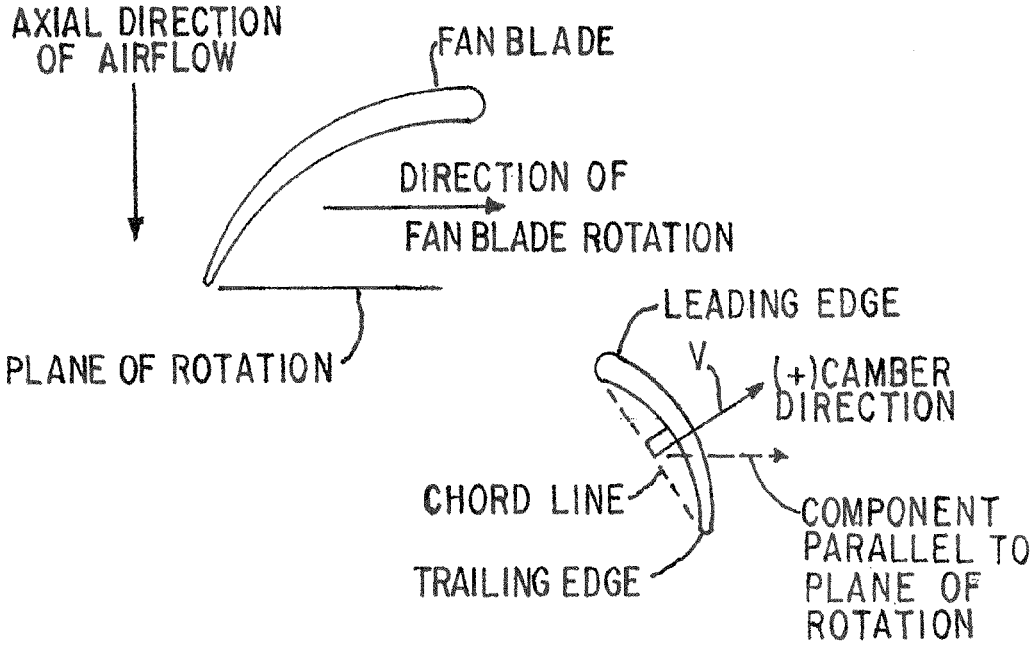
Figure 22:
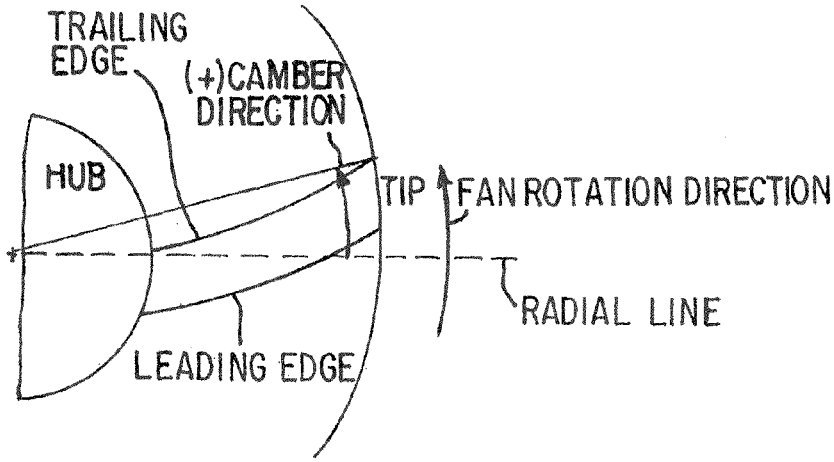

For ease of understanding, Applicants are including several illustrations in FIGS. 20-23. FIG. 20 illustrates a chordwise camber as viewed from a rear direction (i.e., as if airflow was coming directly toward the reader out of the page). The chordwise camber, as viewed from the downstream or pressure side, the chordwise positive camber reference direction is the same direction as circumferential travel along the concave path starting at the trailing edge and ending at the leading edge. Notice that by this definition, the positive camber direction is clockwise. Alternatively, the direction of chordwise camber can be viewed from the downstream or pressure side, the positive camber reference direction is the same direction as a perpendicular vector V (FIG. 21) starting from the chord line, going towards the mean line. In the illustrations being described, this definition leads to a positive camber direction that is counter-clockwise as illustrated in FIG. 21.

Still another way to describe the chordwise camber direction is by reference to the direction of fan rotation, rather than as a counter-clockwise or clockwise reference. Therefore, alternatively, the camber direction can be referred to as a chordwise positive camber direction that is counter to the direction of fan rotation if the chordwise camber reference direction is as viewed in FIG. 20, or chordwise positive camber direction is the same as the direction of the rotation of the fan if the definition or reference of the chordwise is that which is referred to in FIG. 21. For ease of illustration and simplicity, the definition and reference for the chordwise camber as referred to in FIG. 21 will be used to describe various features of the invention.

Figure 23:
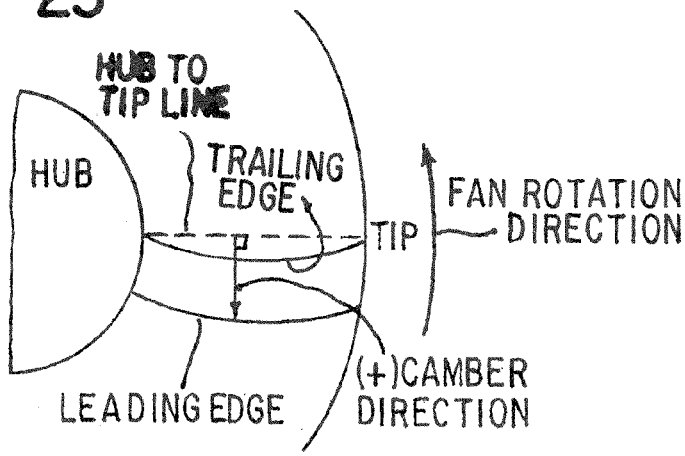

For ease of illustration, the term sweep or spanwise camber, when viewed from a downstream or pressure side of the fan, the spanwise positive camber reference direction is the same direction as the radial travel along a concave path starting at an inner section (small radius) section and ending at a tip section (a large radius) connecting the same features on the inner and outer airfoil cross sections referred to below (that is, both leading edge, or both trailing edge, or both mid-chord locations). Note that if this is the same direction as a perpendicular vector starting from a line connecting the same features on the inner and outer airflow cross-section (that is, both leading edge, or both trailing edge, or both mid-chord locations), going towards a concave path starting at the inner section (the smallest radius) section and ending at the tip section (the largest radius section). If this is the reference, then note that the positive camber direction is clockwise as illustrated in FIG. 23.

Thus, as illustrated in FIGS. 20-23, it should be appreciated that a tangential component of the positive chordwise camber direction parallel to the plane of fan rotation, as illustrated in FIG. 21, is aligned with the direction of fan rotation. Notice that a tangential component of the chordwise camber direction is opposed in the direction of fan rotation, as illustrated in FIG. 20. Notice relative to FIG. 23, that the tangential component of the positive spanwise camber direction is opposed to the component of the positive chordwise camber direction parallel to the plane of fan rotation.

Stated another way, notice in FIG. 3 that each of the plurality of stator vanes 33 has a chordwise axis and a spanwise axis and that these axes are not parallel and comprises a longitudinal cross-section and widthwise cross-section that define the spanwise camber and chordwise camber, respectively. The longitudinal cross-section defines a longitudinal radius of curvature that is larger than a widthwise radius of curvature of the chordwise cross-section as illustrated in FIG. 3. The longitudinal radius of curvature for the spanwise radius is different than the widthwise radius of curvature associated with the chordwise camber.

It should be understood that each side of each of the plurality of stator vanes has an axis of concavity and the two axes are non-parallel. In another embodiment, the two axes are perpendicular. Also, each of the plurality of stator vanes comprises a longitudinal cross-section and a width-wise cross-section, the longitudinal cross-section defining a longitudinal radius of curvature that is larger than a width-wise radius of curvature of the width-wise cross section, the longitudinal radius of curvature being in a different direction than the width-wise radius of curvature.

As with the positive chordwise camber, instead of describing the spanwise direction reference as clockwise or counterclockwise, the spanwise camber direction reference can be linked to the direction of fan rotation. This leads to the alternative definitions which are that the positive spanwise camber direction is the same as the direction of the fan rotation if the reference is the reference or definition referred to in FIG. 22 above as viewed from the downstream side of the fan. Alternatively, if the reference or definition is that which is shown in FIG. 23, then a positive spanwise camber direction is counter to the direction of fan rotation.

For ease of illustration, the reference of definition referred to in FIG. 23 will be used for consistency and simplicity of illustration.

The particular structure of the vanes 33 in FIG. 3 provides several desirable features. The features were demonstrated by finite element analyses undertaken of (1) radial, chordwise cambered vanes, which lack spanwise camber, such as vane 6 in FIG. 2 (camber is not shown), and (2) dual-cambered vanes of the type shown in FIG. 3.

Figure 5:
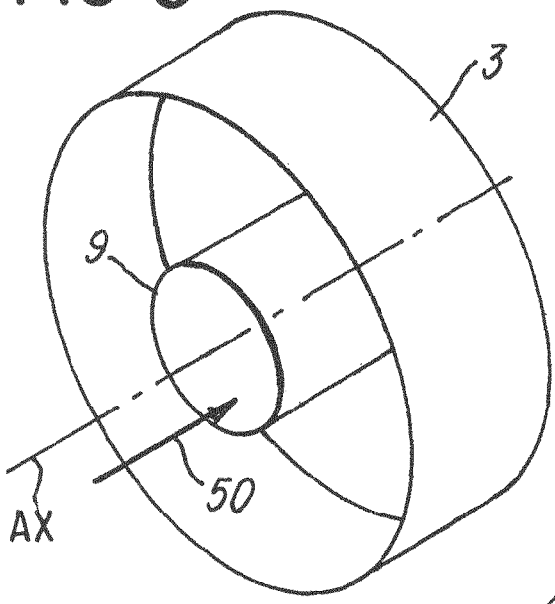
FIG. 5 illustrates an axial force applied during finite element modeling.
Figure 6:
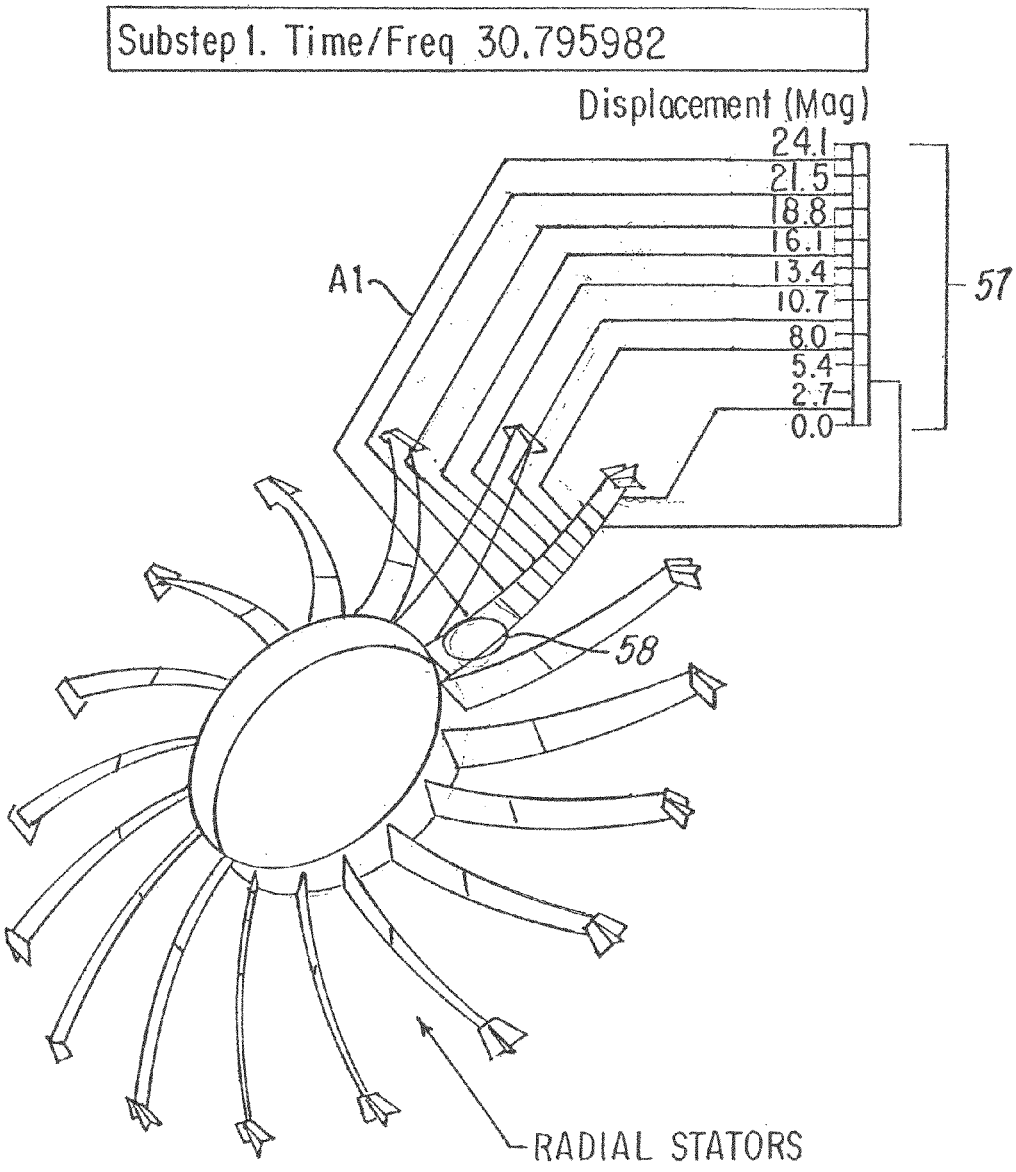
FIGS. 6-7 illustrate exaggerated views of the deformation that occurs at the first resonant mode of the structures.
Figure 7:
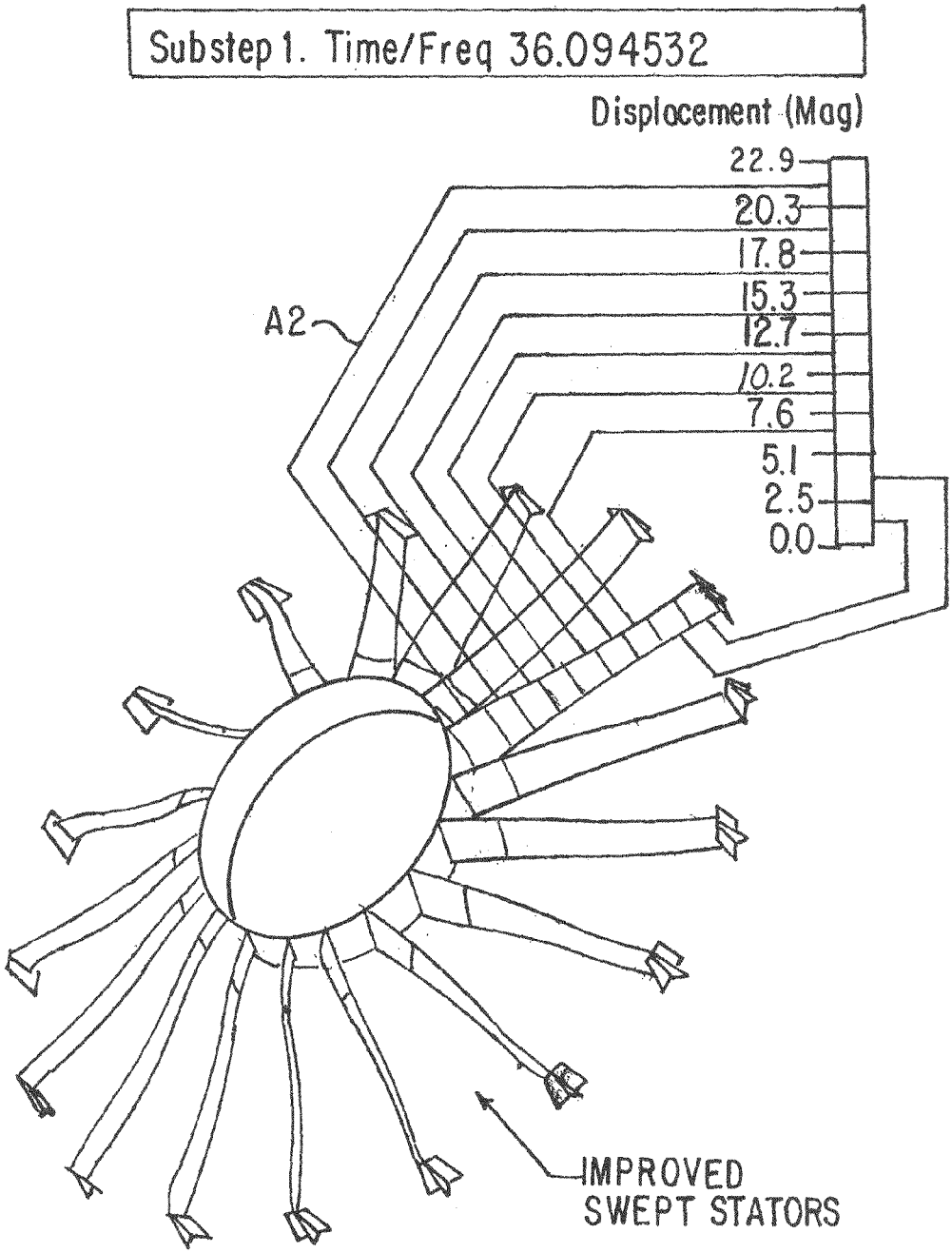
Figure 24A:
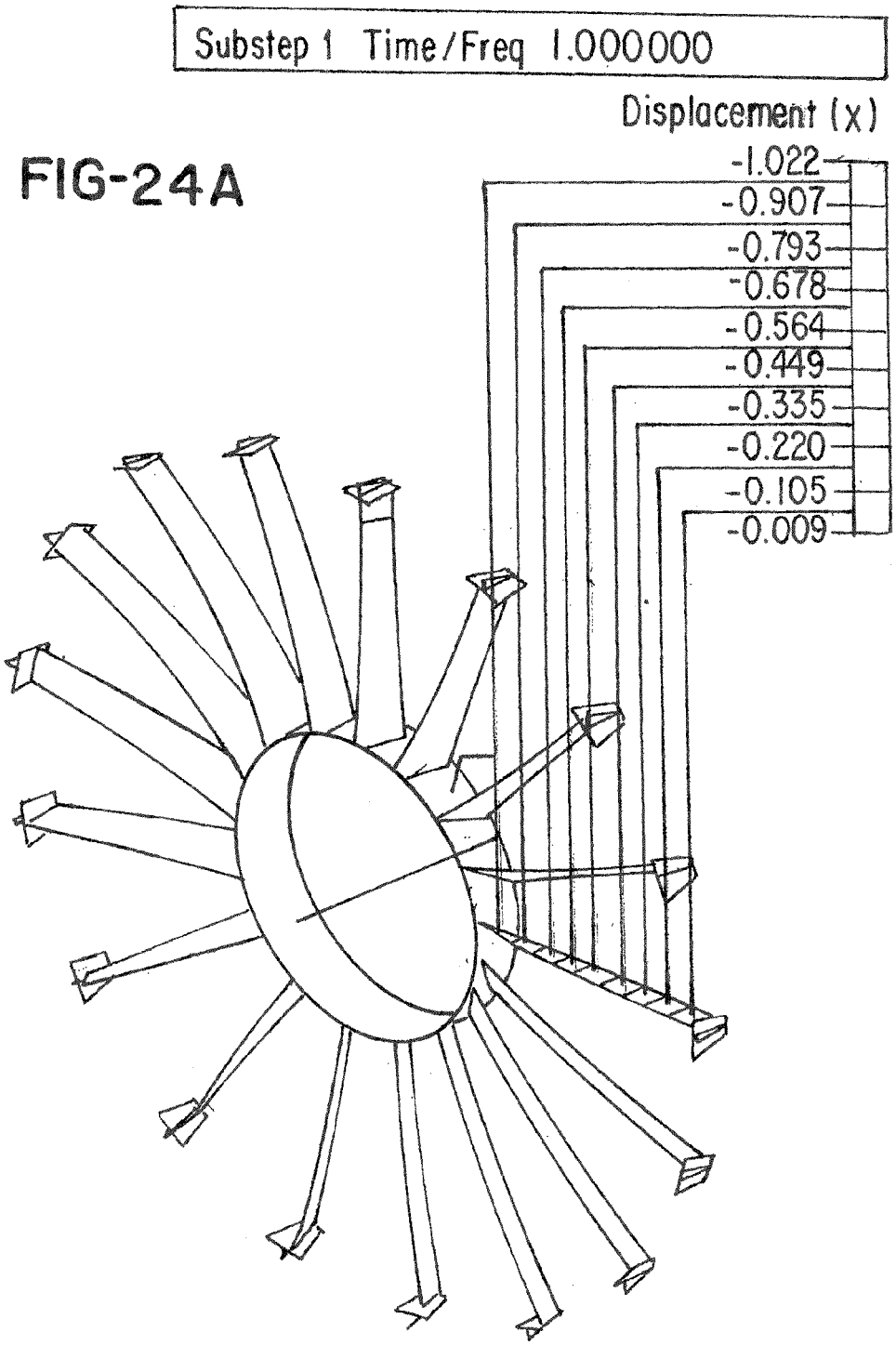
FIGS. 24A-29B show reduction in out-of-plane and in-plane deformation and Von Mises stress with the dual-cambered stators.
Figure 24B:
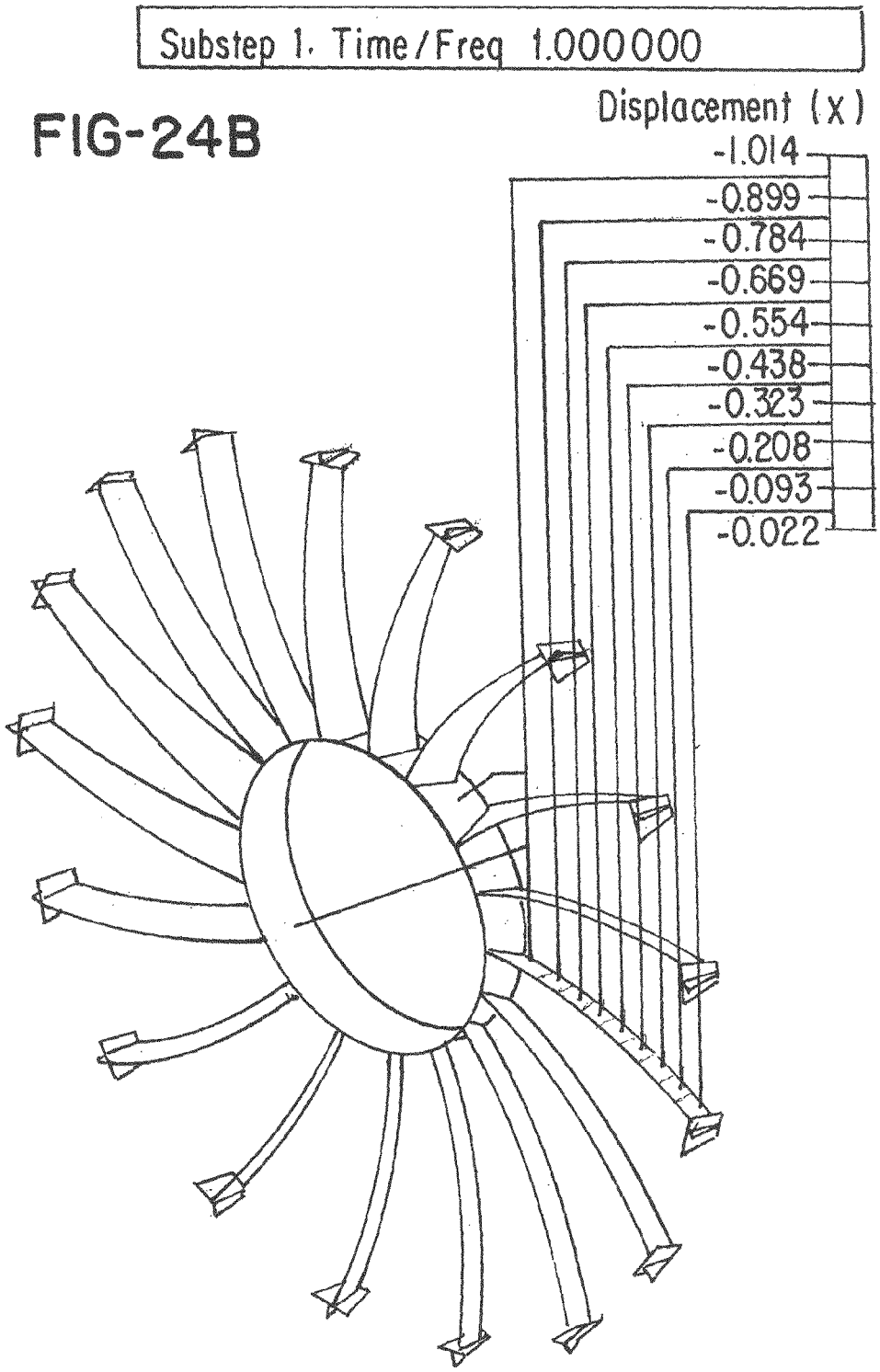
Figure 25A:
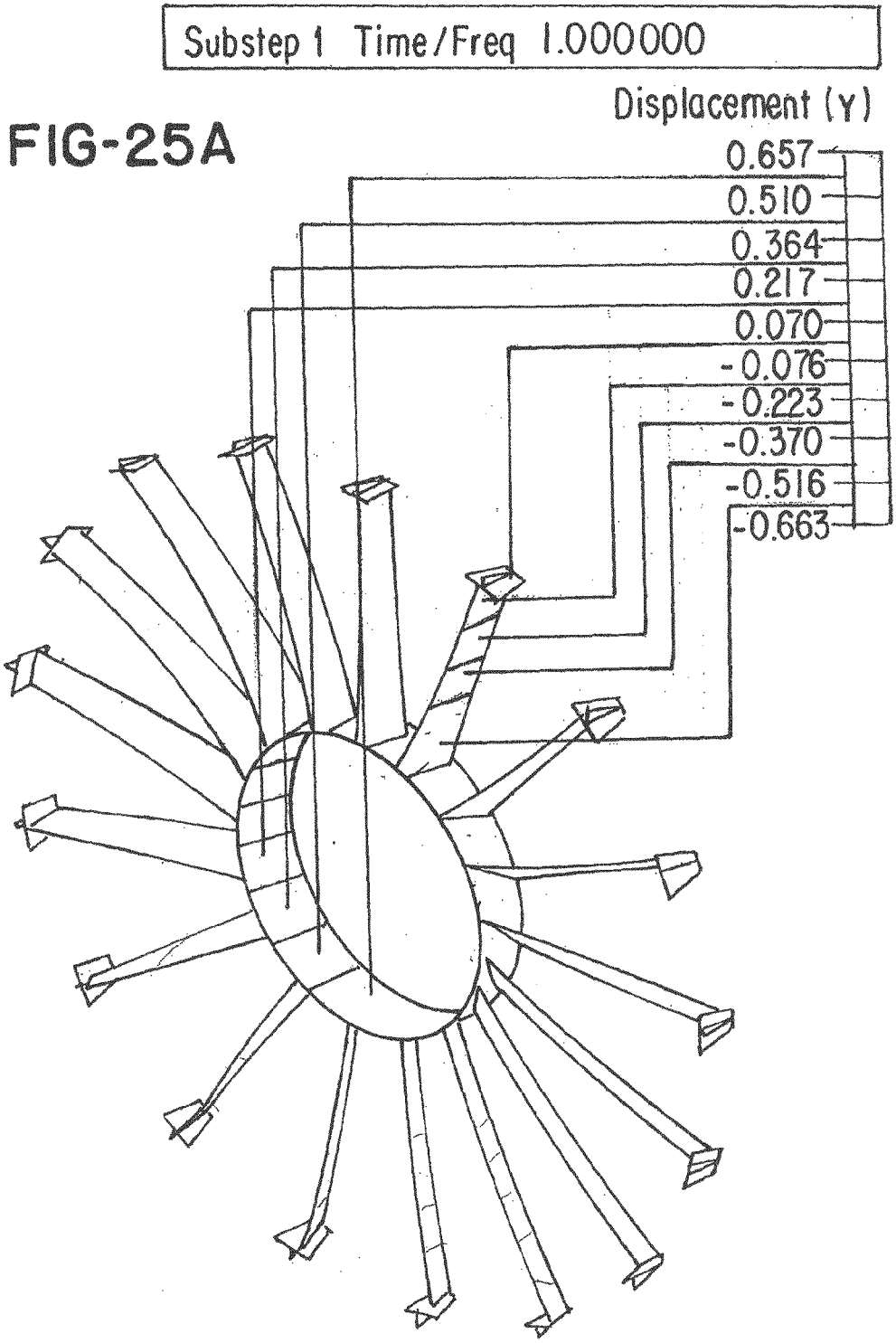
Figure 25B:
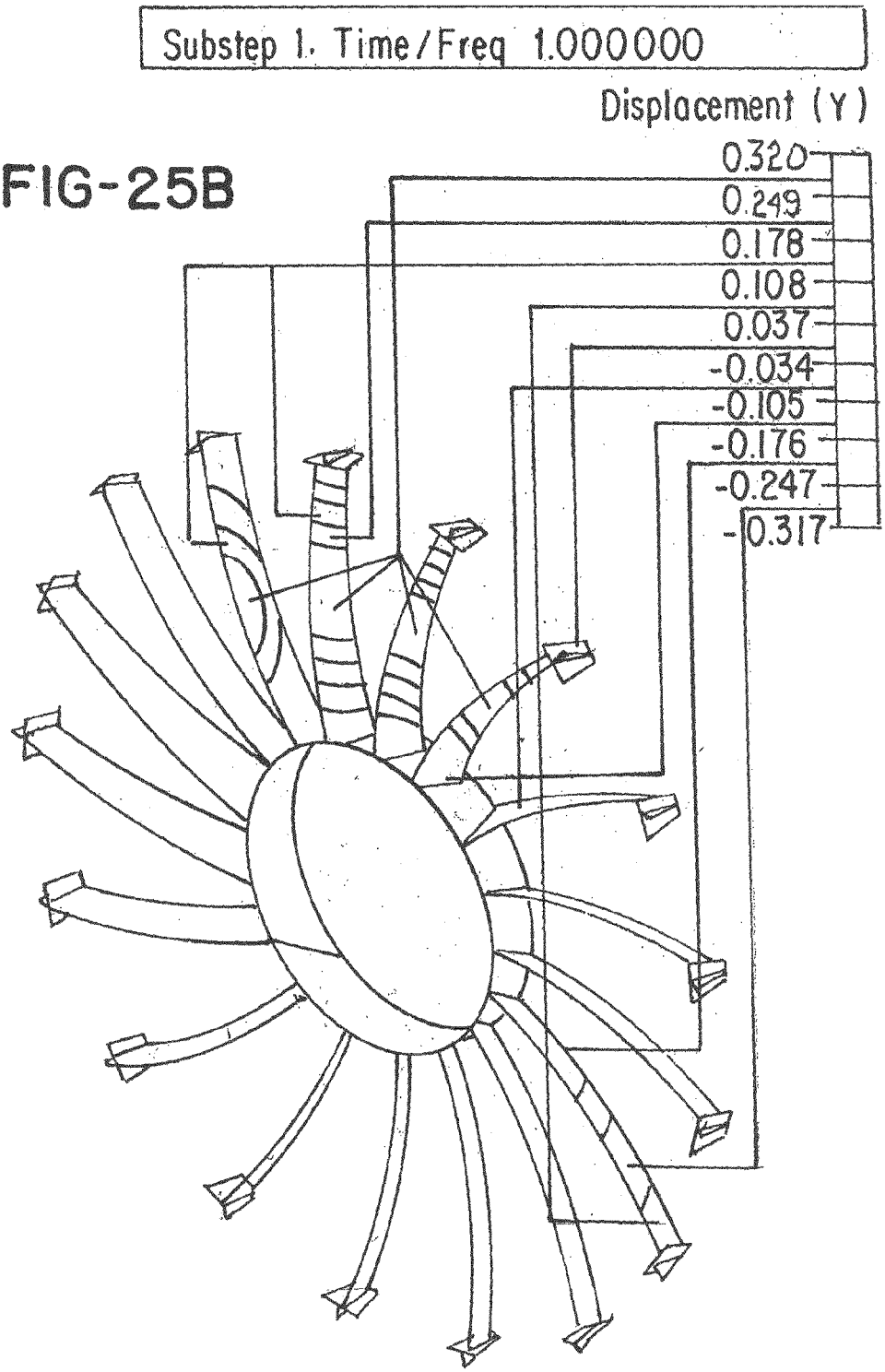
Figure 26A:
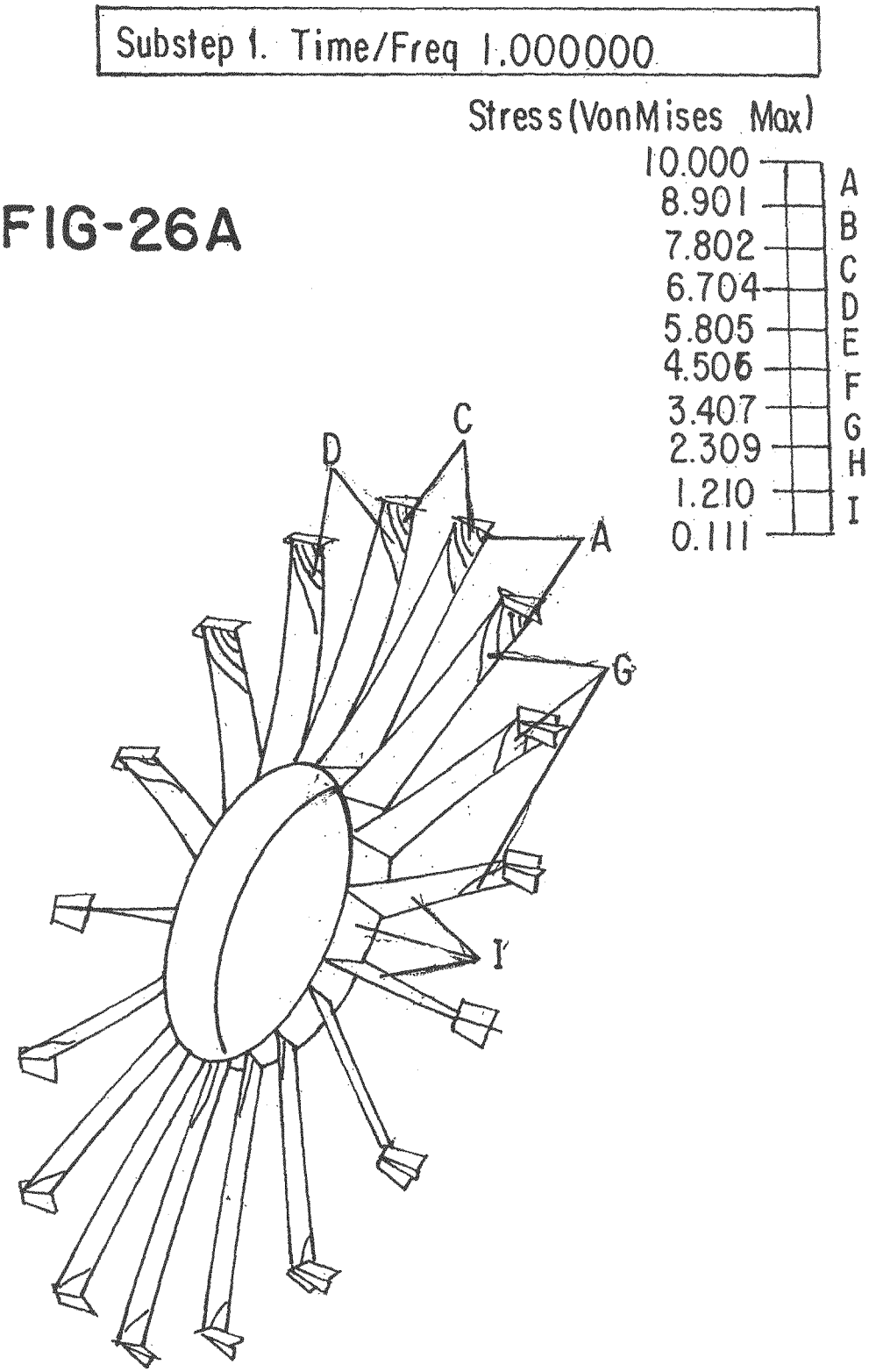
Figure 26B:
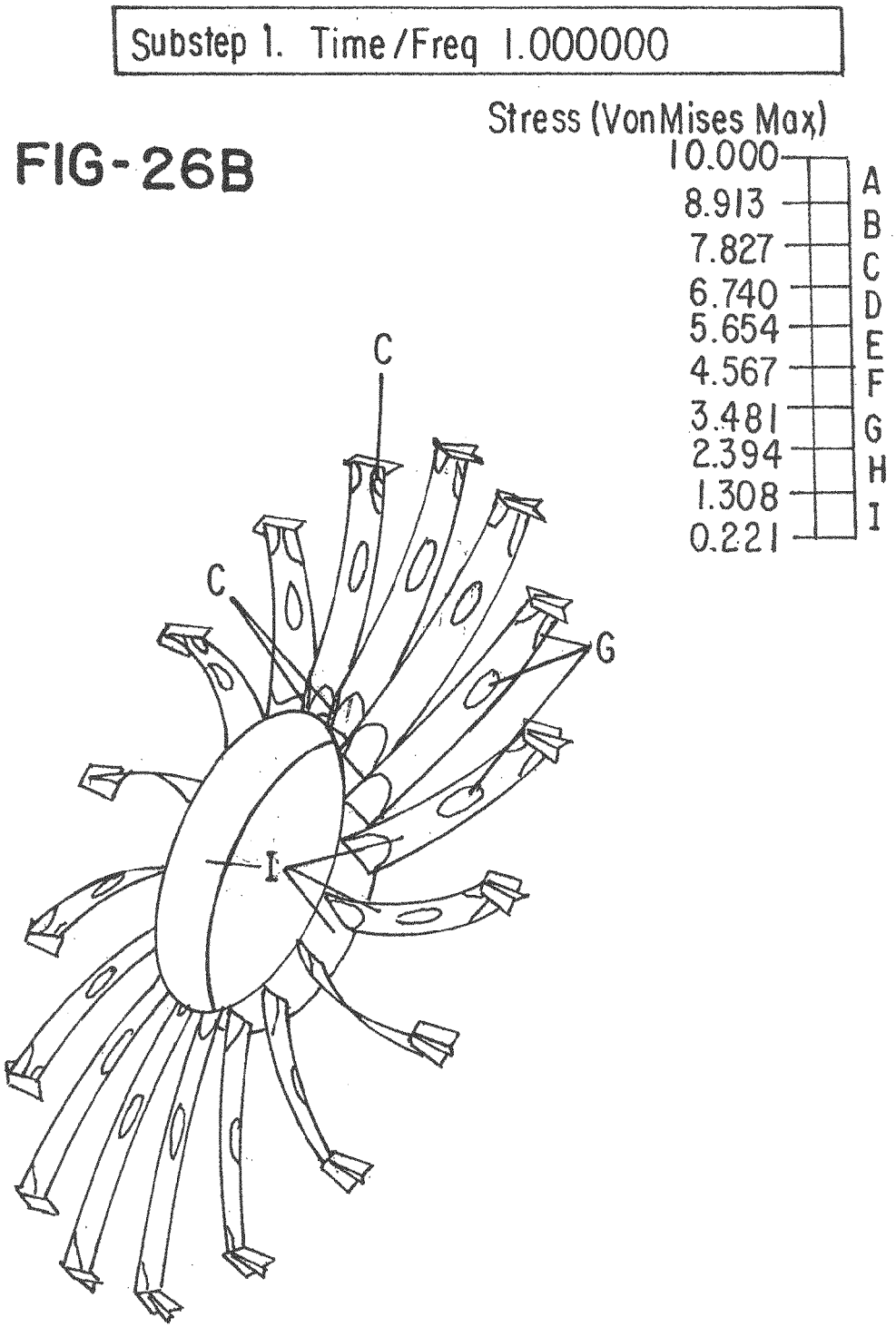
Figure 27A:
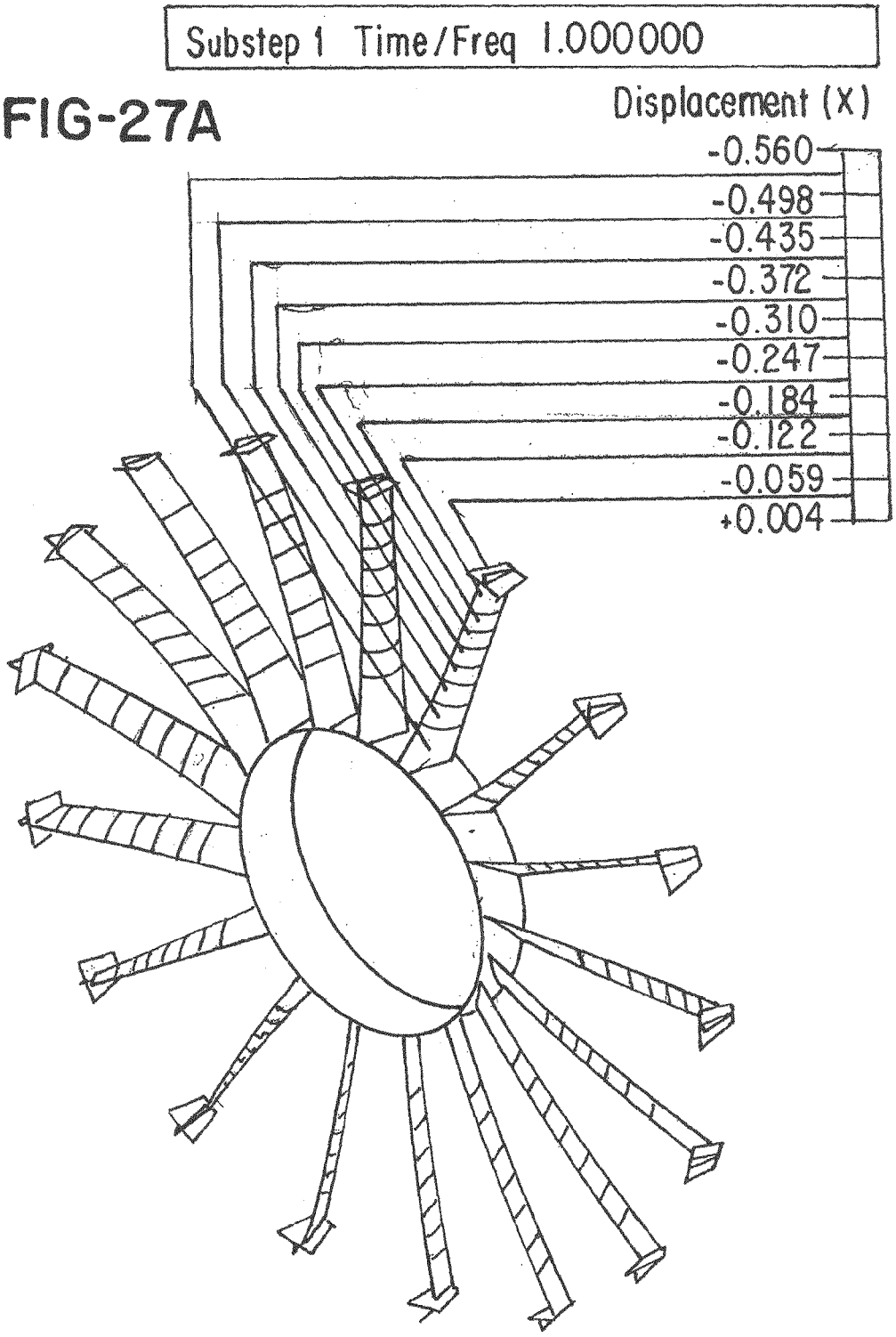
Figure 27B:
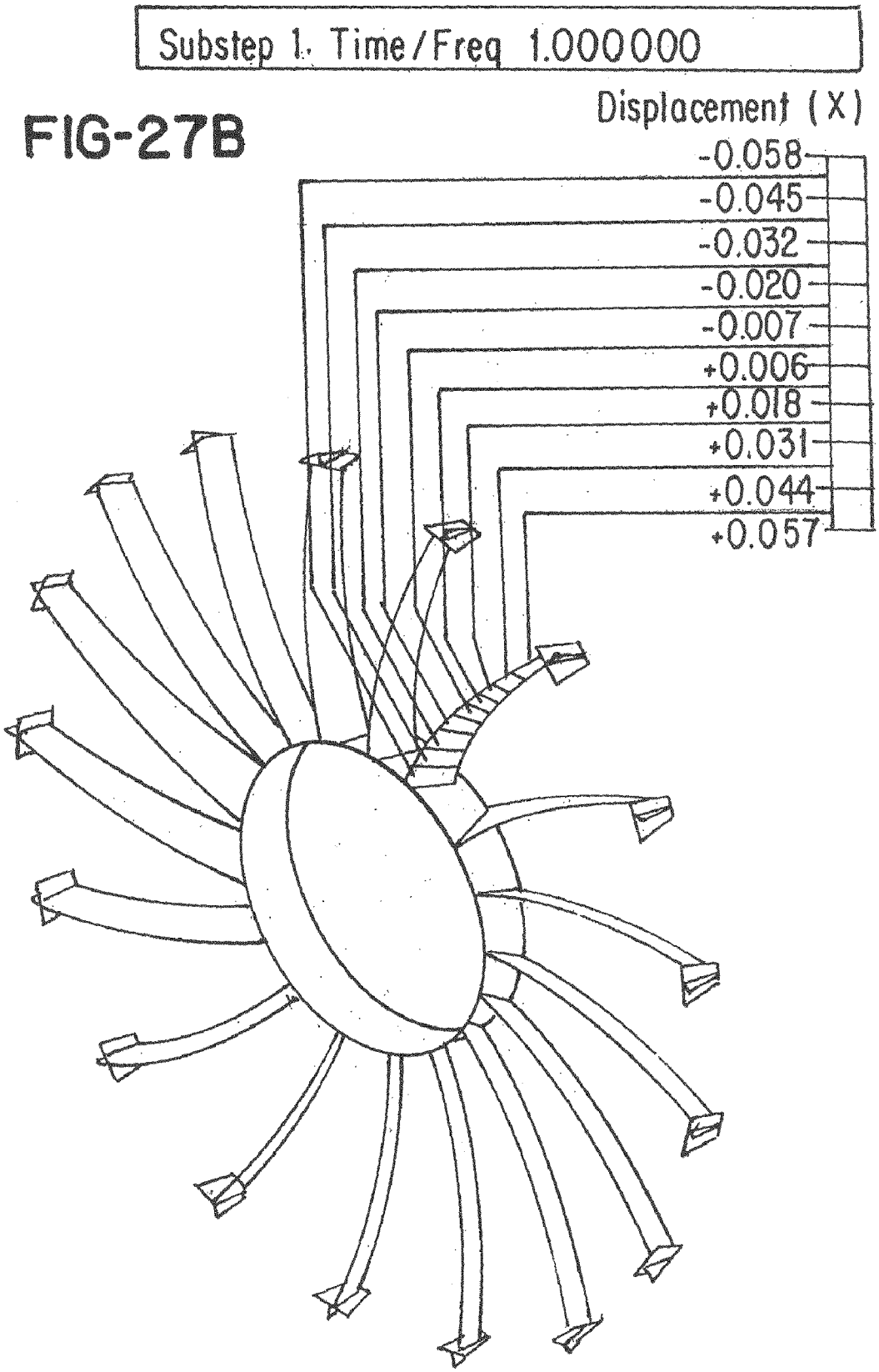
Figure 28A:
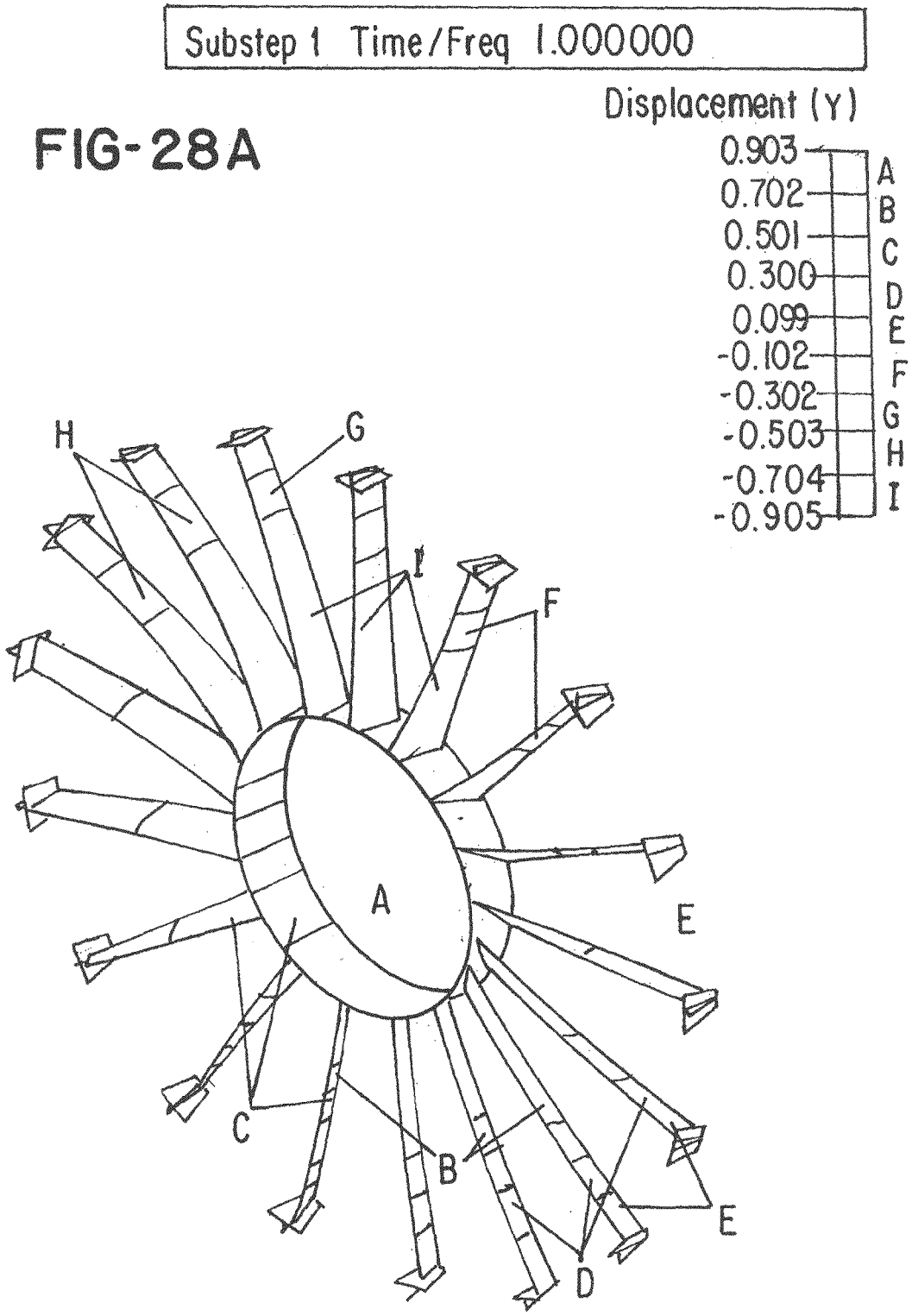
Figure 28B:
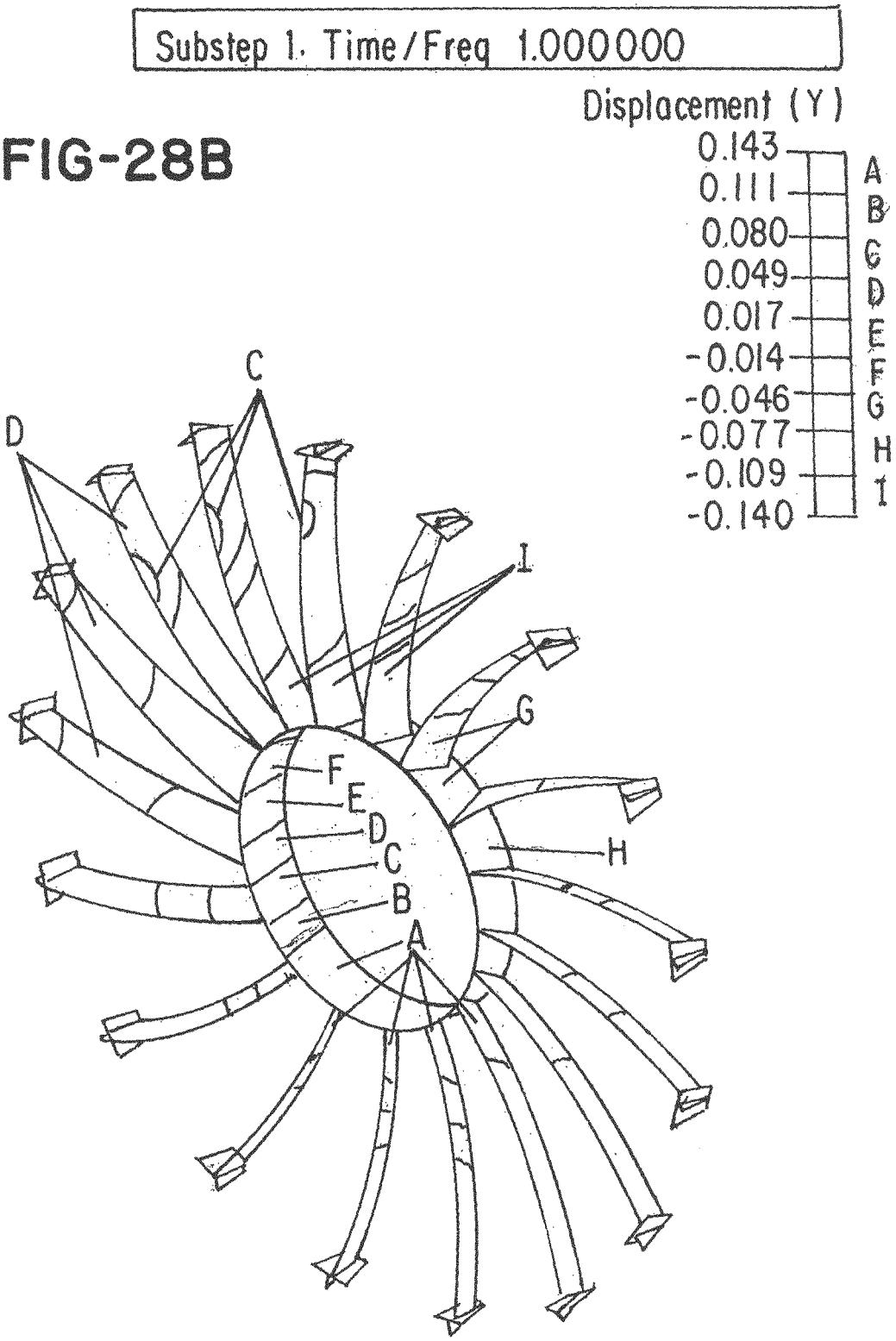
Figure 29A:
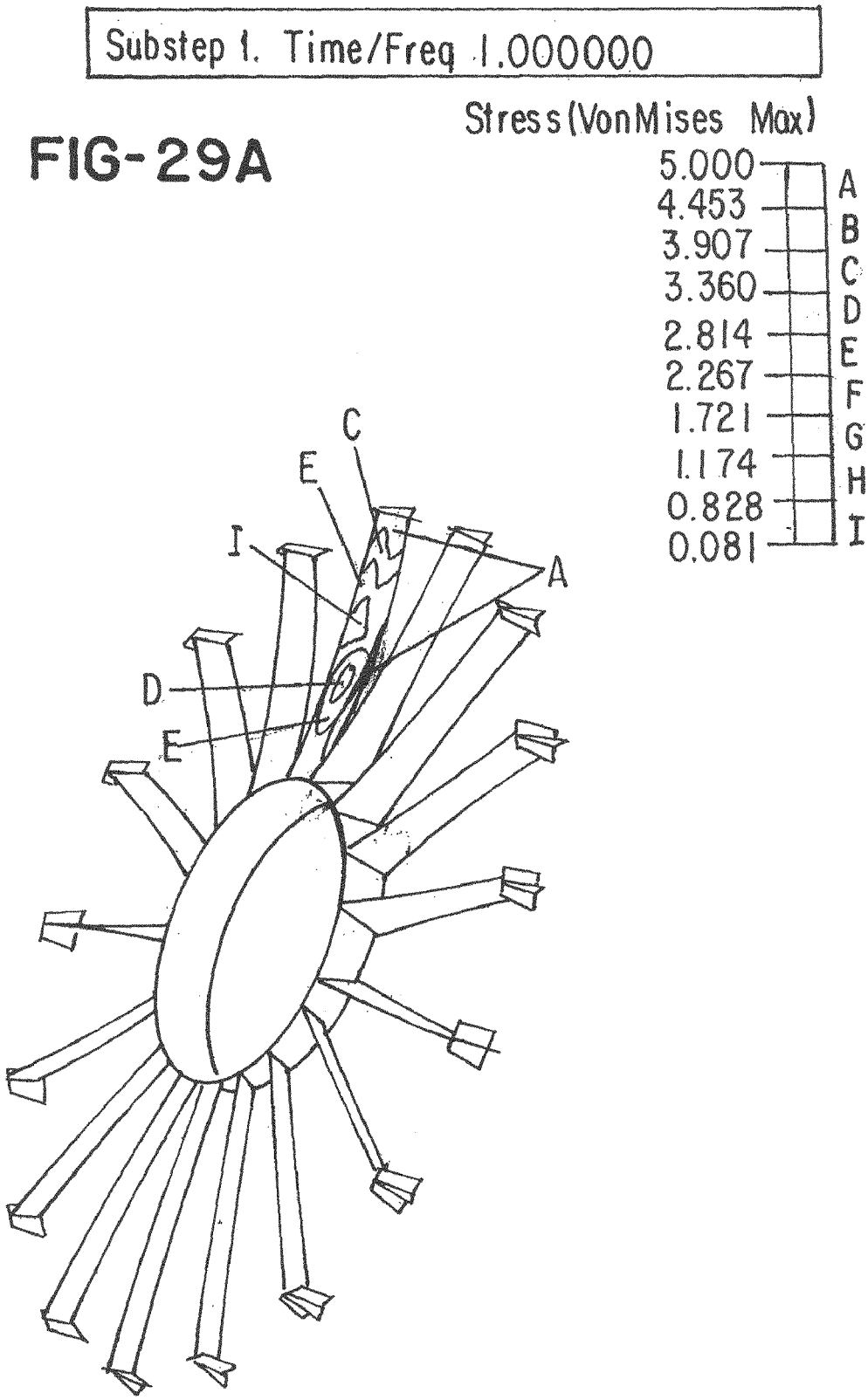
Figure 29B:
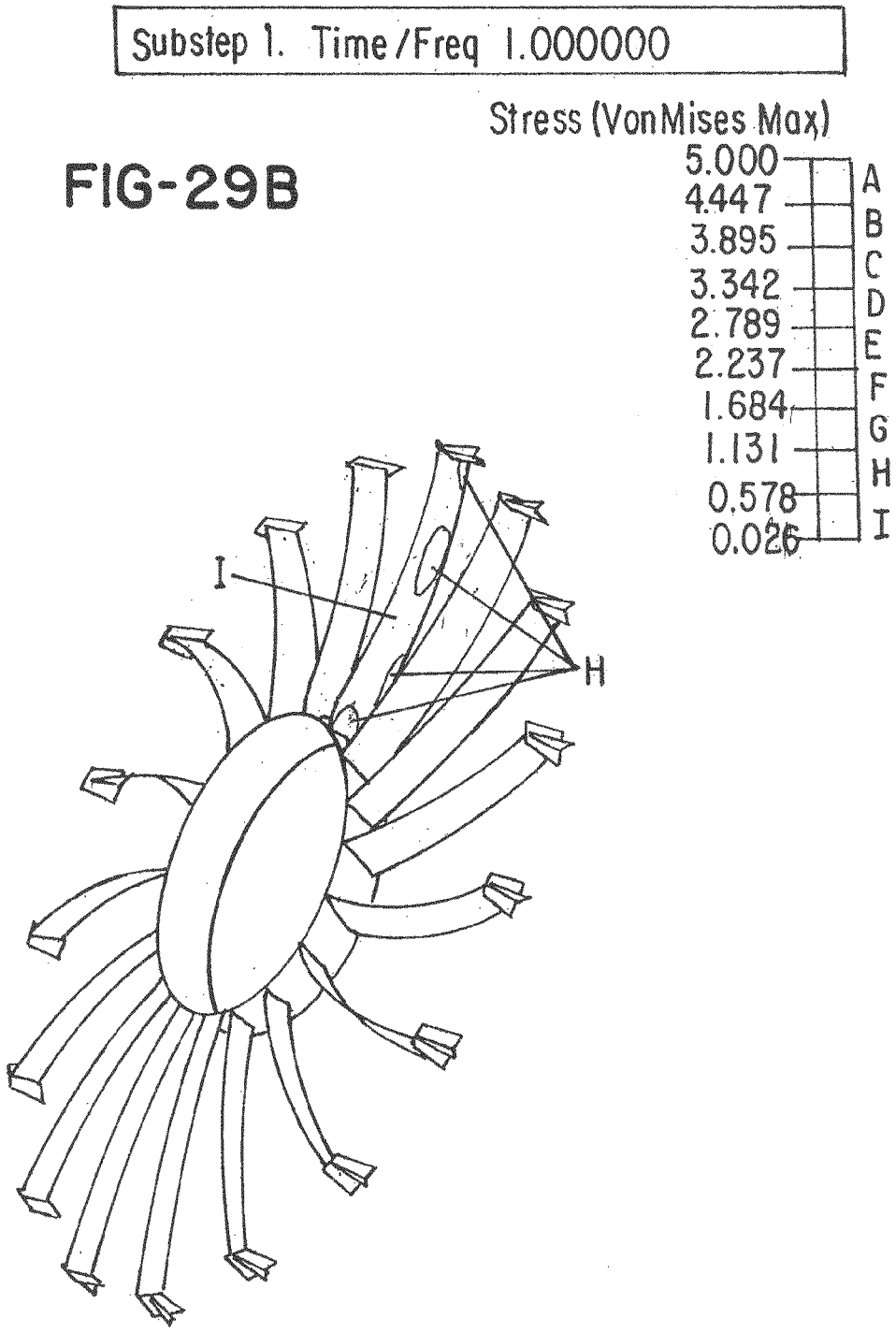

In one analysis, a cyclic axial force was applied to inner ring 9, while outer ring 3 is held stationary. FIG. 5 illustrates the force 50. FIGS. 6 and 7 are exaggerated views of the deformation that occurs at the first resonant mode of the vanes 33. The contour magnitudes are not "real," but give the relative deformation of different parts of the structure with respect to each other. Note also that FIGS. 24-26 show reduction in out-of-plane and in-plane deformation and Von Mises stress with the dual cambered stators. The software used to perform the analysis produced a scale 57, which is displayed on a computer monitor as a multi-colored spectrum. Because the Figures are monochrome drawings, the colored spectrum will not be used, but arrows will connect colored cells in the scale 57 to the corresponding regions of the vanes. For example, arrow A1 indicates a relative deflection in the range of 21.5 to 24.1 units for span line 58.

It should be noted that the force 50 in FIG. 5 is cyclic, and thus the deflection will be cyclic, that is, in-out-in-out. FIG. 6, and similar Figures, illustrates the deflection occurring at the time of maximum deflection.

Arrow A2 in FIG. 7, compared with arrow A1 in FIG. 6, indicate that the deflection of the corresponding regions is smaller for the dual-cambered stators of FIG. 3.

Figure 10:
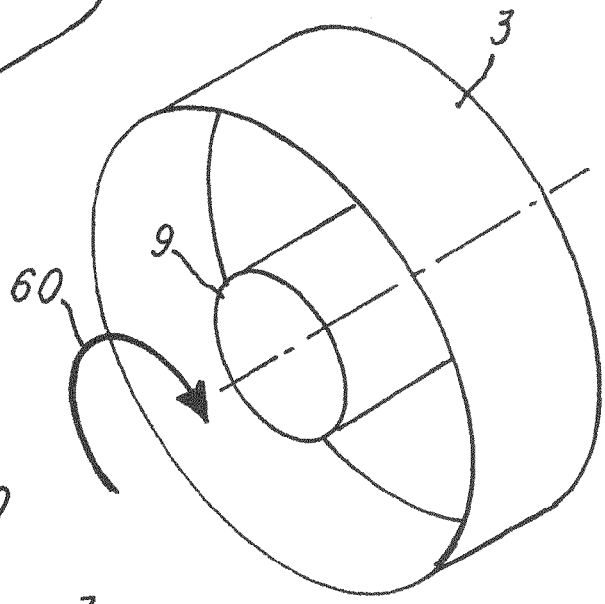
FIG. 10 illustrates a moment applied about the axis of rotation of the fan, applied during finite element modeling.
Figure 8:
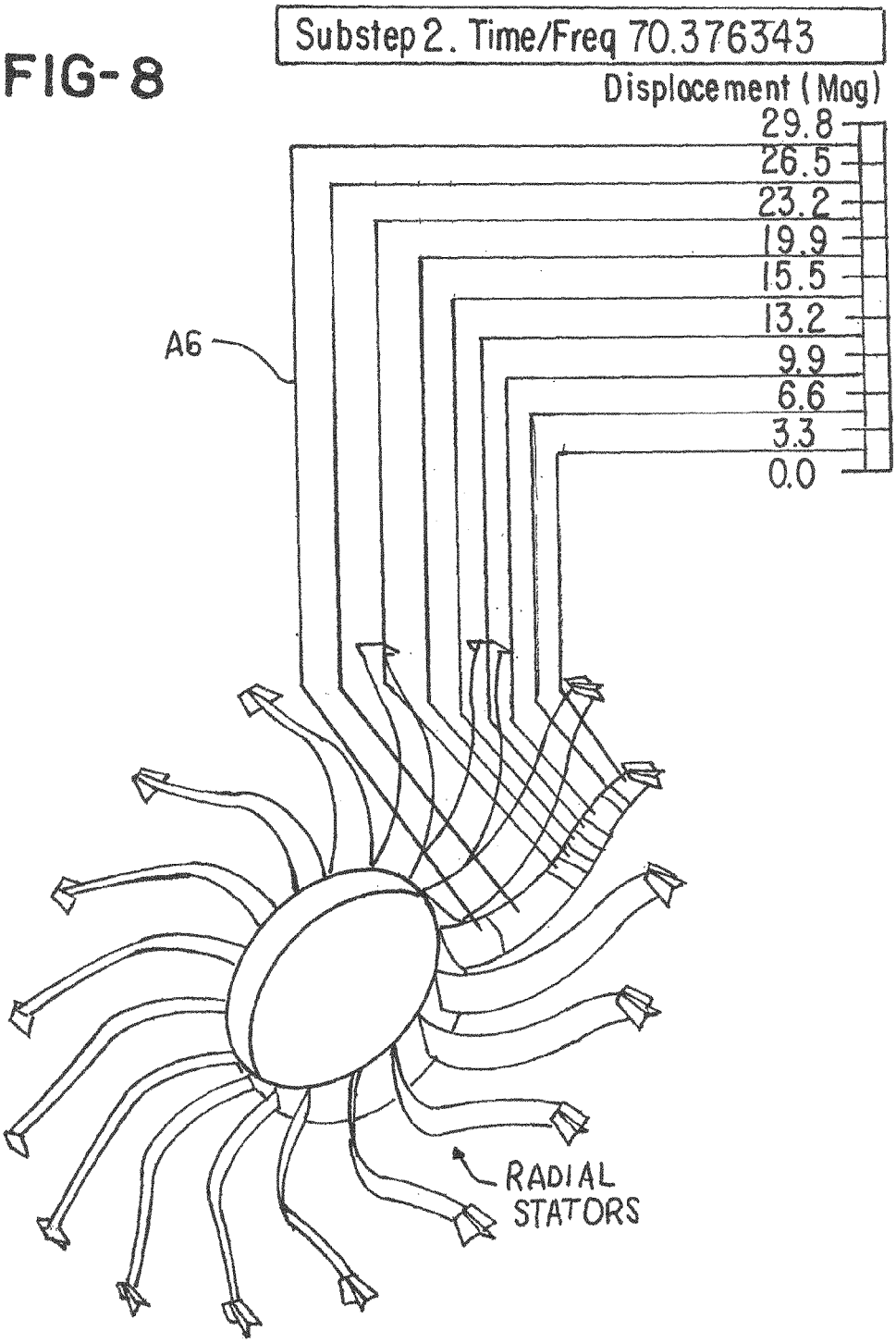
FIG. 8 illustrates simulation results indicating the response of radial stators to the applied moment of FIG. 10.
Figure 9:
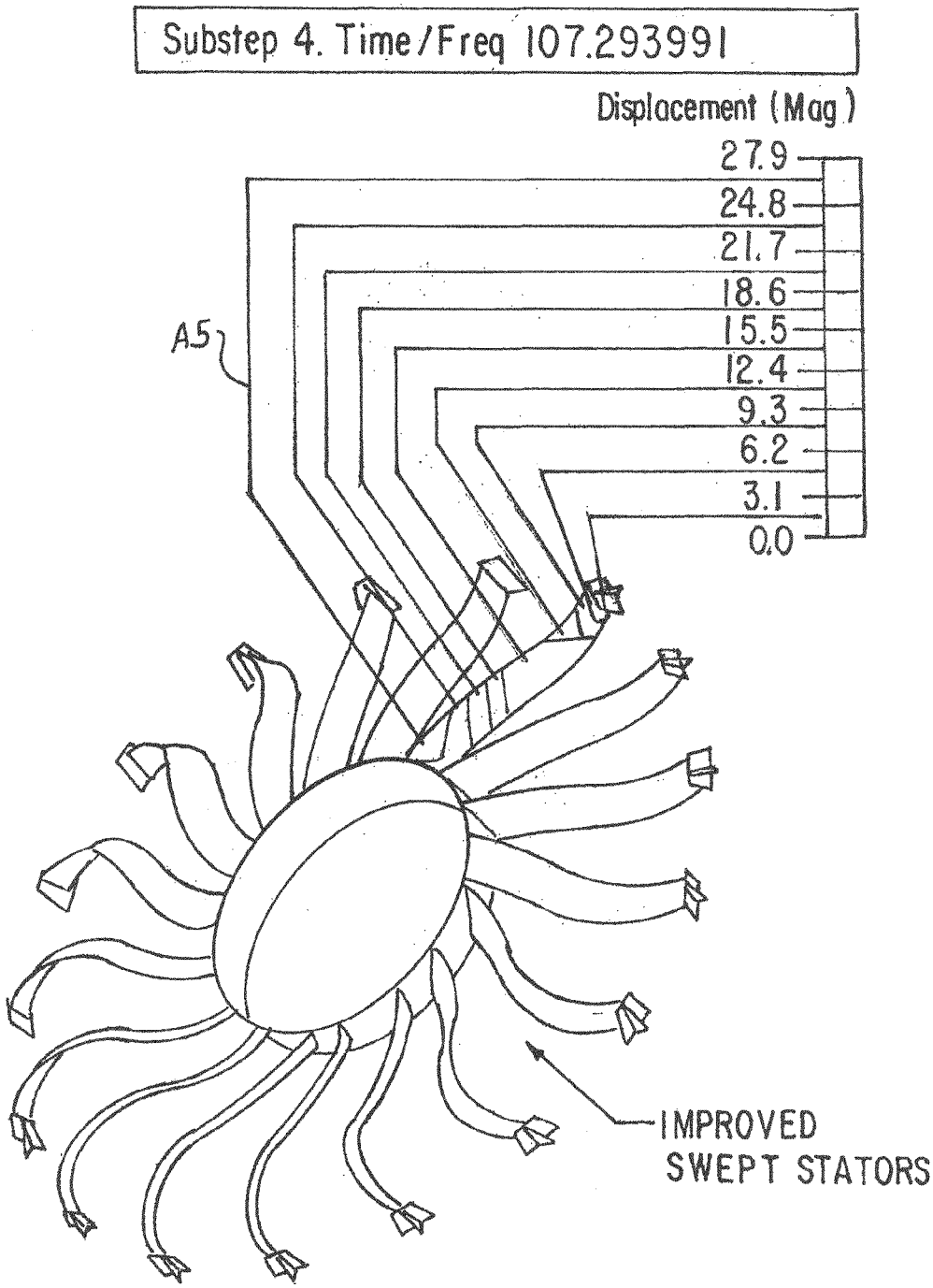
FIG. 9 illustrates simulation results indicating the response of dual-cambered stators of the type shown in FIG. 3, to the applied moment of FIG. 10.
Figure 11:
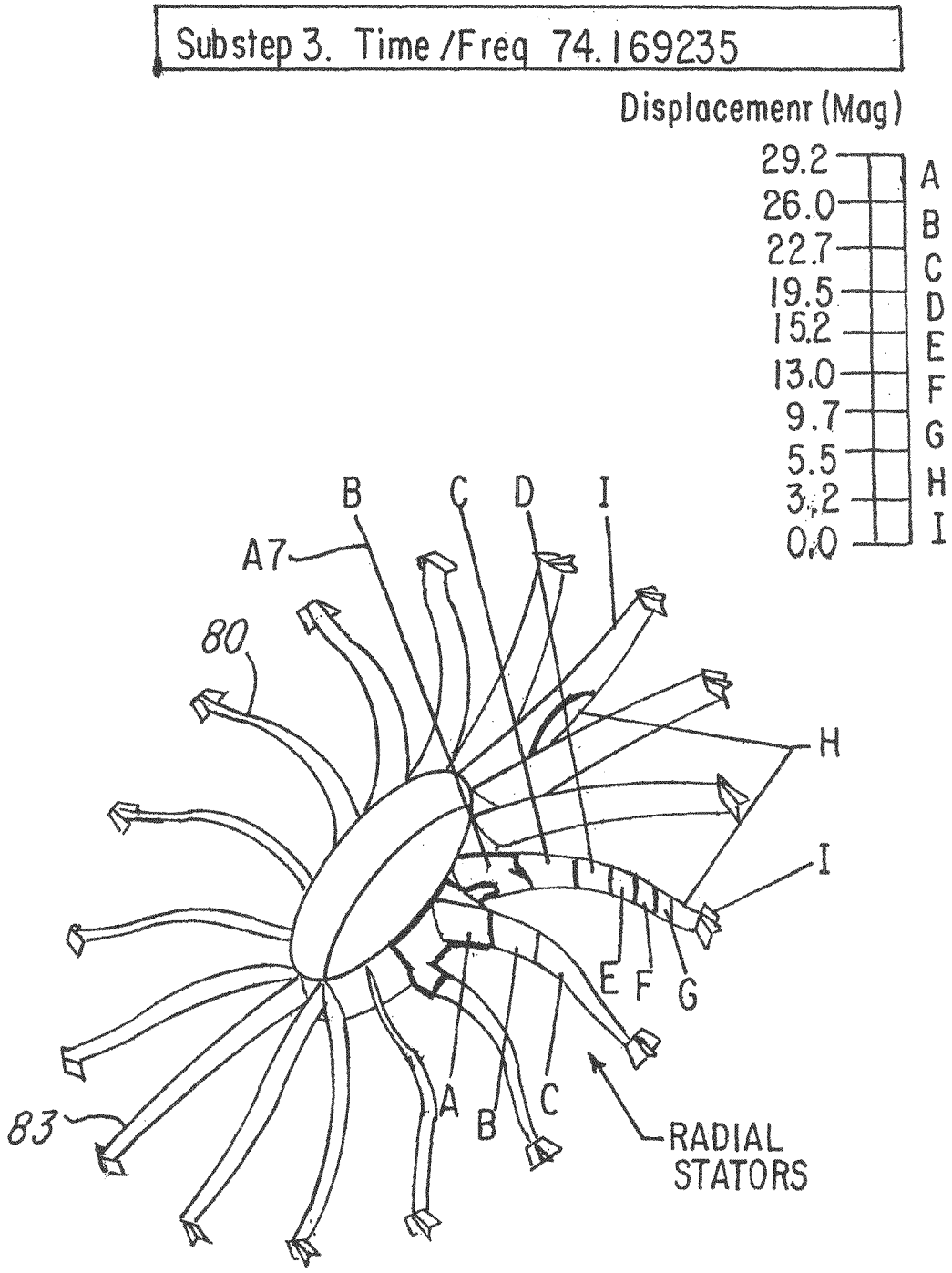
FIG. 11 illustrates simulation results indicating the response of radial stators to the applied gymbaling force of FIG. 13.
Figure 12:
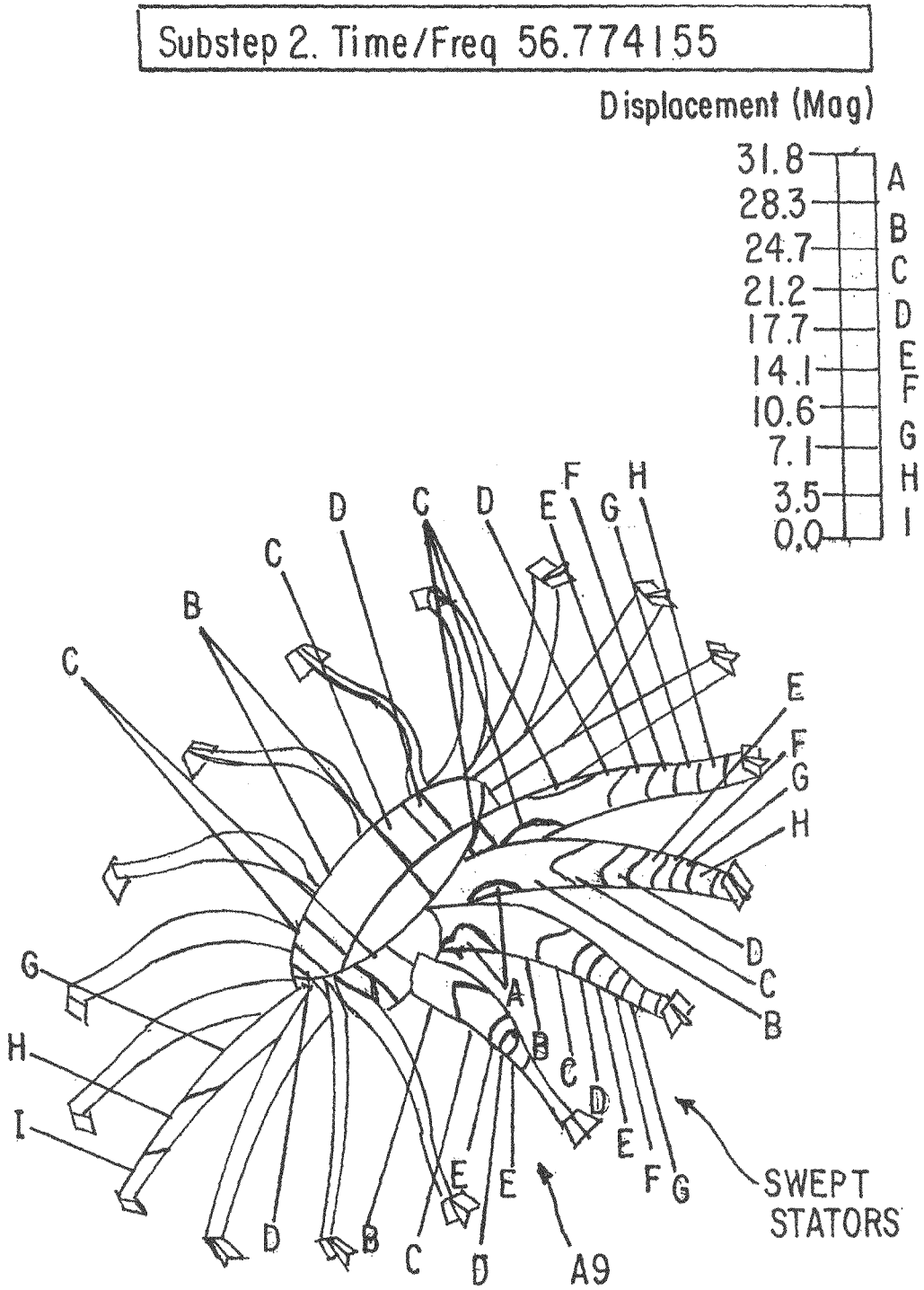
FIG. 12 illustrates simulation results indicating the response of dual-cambered stators of the type shown in FIG. 3, to the applied gymbaling force of FIG. 13.

In the simulations of FIGS. 8 and 9, a moment was applied to the inner ring 9, with outer ring 3 held stationary. FIG. 10 illustrates the moment 60 applied to the inner ring 9. FIGS. 8 and 9 are exaggerated views of the deformation that occurs at higher resonant modes of the structures (mode 2 for the radial stators—FIG. 8, and mode 4 for the dual-cambered stators—FIG. 9). Note also that FIGS. 27A-27B, 28A-28B and 29A-29B show reduction in out-of-plane and in-plane deformation and Von Mises stress with the dual-cambered stators 115. A comparison of arrow A5 in FIG. 9 with arrow A6 in FIG. 8 indicates, again, that deflection is less for the dual-cambered stators of FIG. 3. FIGS. 11 and 12 are exaggerated views of the deformation that occurs at higher resonant modes of the structures (mode 3 for the radial stators—FIG. 11, and mode 2 for the dual-cambered stators—FIG. 12).

Figure 13:
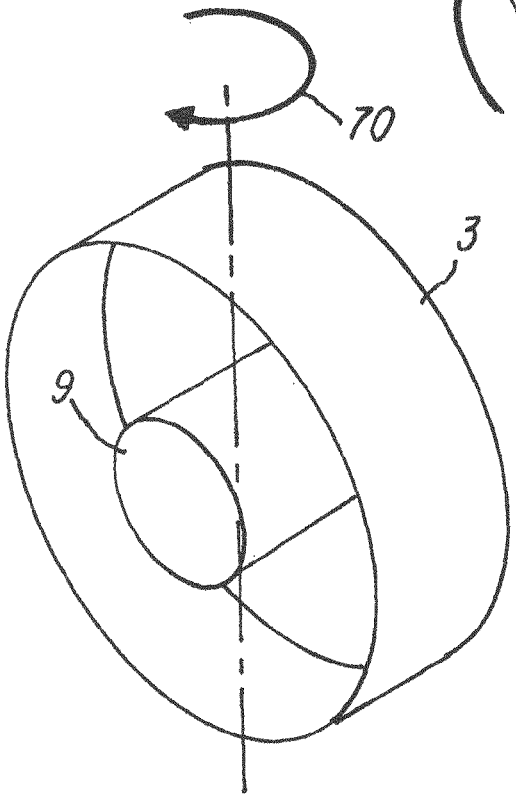
FIG. 13 illustrates a moment applied perpendicular to the axis of rotation of the fan, applied during finite element modeling.

FIG. 13 illustrates the gymbaling force 70. It applies a moment about an axis which is perpendicular to the axis AX of the fan in FIG. 5. The drop in natural frequencies associated with the "gymbaling" (out of plane bending) modes with dual-cambered stators implies that these stators are relatively less stiff for these modes. Although there is a loss of stiffness, the out of plane bending modes typically occur at higher frequencies compared to the axial and torsional modes of radial stators, so these frequencies are not that much of a concern from a vehicle application point of view.

FIG. 11 illustrates the simulation for the case of radial stators. FIG. 12 illustrates the case of dual-cambered stators, of the type shown in FIG. 3. A comparison of arrow A7 in FIG. 11 with arrow A9 in FIG. 12 indicates, again, that deflection is less for the dual-cambered stators of FIG. 3.

FIG. 14 is a summary of simulation results. Line L1 refers to the situations of FIGS. 6 and 7. Line L2 in FIG. 14 refers to the situations of FIGS. 8 and 9.

Column C1 refers to the radial stators, of FIGS. 6, 8, and 10. Column C2 refers to the dual-cambered stators of the type shown in FIG. 3, in the simulations of FIGS. 7, 9, and 12. Column C3 refers to the change in natural frequency found, between the radial stators and the dual-cambered stators. Column C4 refers to the change in global stiffness in the two cases.

In FIG. 14, the term "in-phase" refers to the fact that, in some deflections, all blades deform into approximately the same shape, as in FIG. 6 for example. "Out-of-phase" refers to the fact that all blades do not deform into the same shapes. For example, blades 80 and 83 in FIG. 11 deform into different shapes.

Simulations were also done for static loading. FIG. 15 is a summary of results. Line L10 refers to axial loading of the type shown in FIG. 5. Line L11 refers to an applied moment, of the type shown in FIG. 10.

Block B1 refers to the axial movement of the ring 9. However, this ring 9 does not form the "roots of the stators." Typically, the "roots" of the stator are the portions that deflect less, which are the tips of the stator vanes 33 at the outer ring (3). "Radial" refers to radial stators. "Swept" refers to the dual-camber stators of FIG. 3. Block B2 refers to the circumferential movement of the outer ring 3, or roots of the stators, in the direction of the arrow shown in FIG. 10. Block B3 refers to the changes in Von Mises Stresses.

Figure 16:
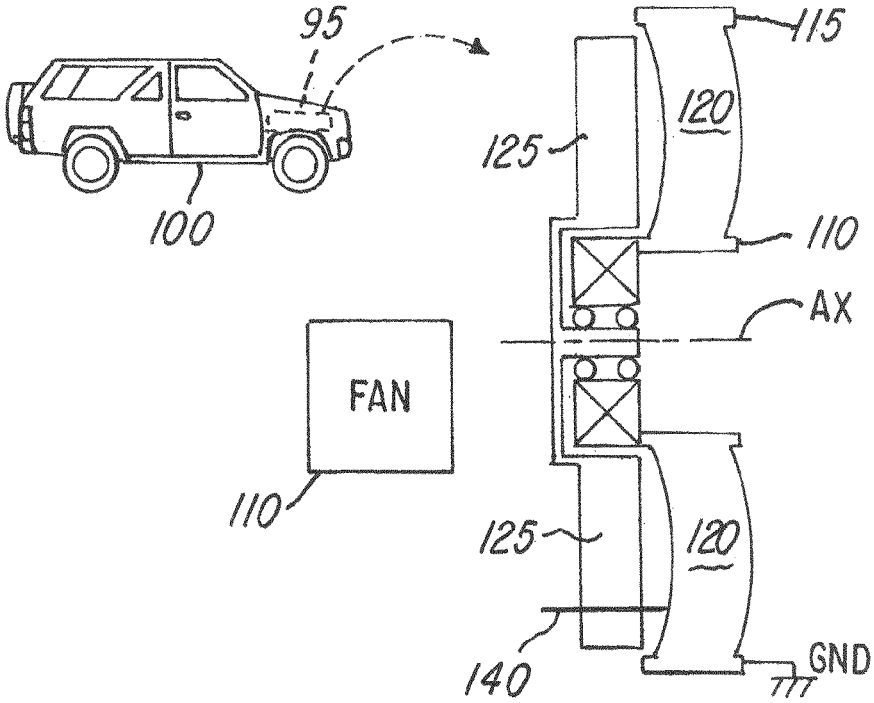
FIG. 16 illustrates one form of the invention.

FIG. 16 illustrates one form of the invention. A heat exchanger 95, such as a cooling radiator, is present within a motor vehicle 100. A fan 110 is present, having dual-cambered stators 115, of the type discussed herein.

Figure 17:
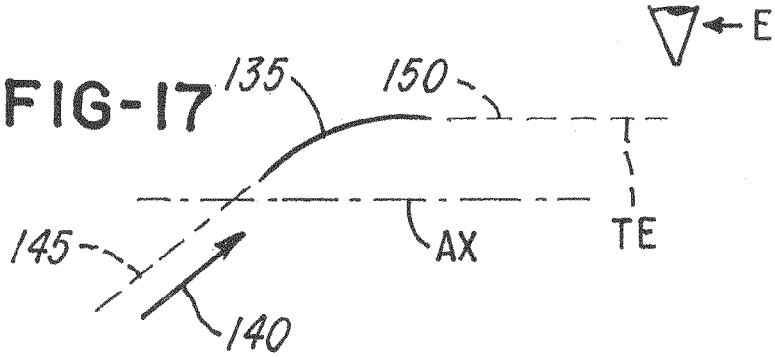
FIGS. 17 and 18 illustrate a specific embodiment.

FIG. 17 illustrates a specific embodiment of the stators, in cross-section. The tangent 145 to the camber line 135 at the leading edge LE is parallel to the mean incoming airstream 140, at one operating point of the system. The direction of the mean incoming airstream 140 will change, as the operating point (that is, engine speed) changes. The operating point selected at which parallelism is secured may be (1) the operating point which occurs most often in time, (2) the operating point at which the cooling system requires the maximum volume of cooling airflow, or (3) another desired point.

The tangent 150 to the camber line 135 at the trailing edge TE is parallel to the axis of rotation AX.

Figure 18:
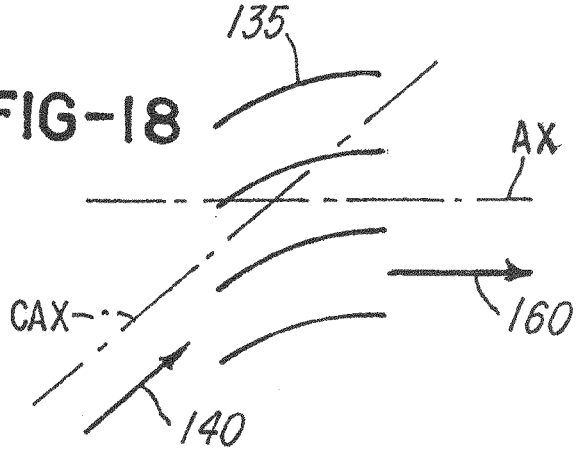

FIG. 18 is a view, viewed from the direction of arrow E in FIG. 16. The vanes, represented by camber lines 135, accept the incoming airstreams 140, which represent the exhaust of the fan 125 in FIG. 16, and which have a component of motion in the tangential direction.

Each adjacent pair of vanes cooperates to define an inlet channel, having a central axis CAX. The vanes are configured so that the central axis CAX of the inlet channel is parallel to the incoming airstreams 140. The vanes redirect the incoming airstreams to be parallel with the axis AX.

The term axis of concavity can be defined. In FIG. 4, such an axis would lie midway between the leading and trailing edges and extend perpendicularly into the paper. For example, if the bottom surface of the airfoil shown were parabolic in shape, concave downward, then the axis of concavity would be a line coincident with the focus of the parabolic surface.

Numerous substitutions and modifications can be undertaken without departing from the true spirit and scope of the invention. What is desired to be secured by Letters Patent is the invention as defined in the following claims.

The invention claimed is:

1. A motor vehicle comprising:

a cooling fan rotatably driven by a motor; said cooling fan comprising:

i) a support which carries said motor which drives fan blades; and ii) stators coupled to said support;

said stators being chordwise concave on a first side and are spanwise concave on a second side, wherein said spanwise concaving and chordwise concaving are in opposite directions, with said spanwise concaving being substantially the same as a direction of rotation of said cooling fan.

2. An apparatus comprising:

a) a base effective to support a fan motor;

b) a plurality of supports extending from the base;

said plurality of supports each redirecting exhaust of a fan and increasing natural frequency of the base-support combination in at least one mode of vibration, compared to a second base-support combination comprising a plurality of radial supports, wherein each of said plurality of supports comprises a spanwise camber and a chordwise camber that are directed in opposite directions, with said spanwise camber being generally the same as a direction of rotation of said fan.

3. The apparatus according to claim 2, wherein the increase in natural frequency is in an axial displacement mode, wherein the base oscillates along an axis of rotation of the fan.

4. The apparatus according to claim 2, wherein the increase in natural frequency is in a torsional mode, wherein the base oscillates in rotation about an axis of rotation of the fan.

5. The apparatus according to claim 2, wherein i) an increase in natural frequency occurs in an axial displacement mode, wherein said base oscillates along an said axis of rotation of the fan; and ii) an increase in natural frequency occurs in a torsional mode, wherein said base oscillates in rotation about said axis of rotation of the fan.

6. A fan assembly comprising:

a) a base for supporting a fan motor that rotatably drives a fan; and b) a plurality of stator vanes extending from the base, each of said plurality of stator vanes having at least two sides, both sides being generally arcuate in cross section in opposite directions, with a first side defining a chordwise camber and a second side defining a spanwise camber, wherein said chordwise camber and said spanwise camber are in opposite directions with said spanwise camber direction being in a common direction of said rotation of said fan.

7. The fan assembly according to claim 6, wherein each side of each of said plurality of stator vanes has a chordwise axis concavity and a spanwise axis concavity and the chordwise axis and spanwise axis are non-parallel.

8. The fan assembly according to claim 7, wherein the two axes are perpendicular.

9. The fan assembly according to claim 6, wherein each of said plurality of stator vanes comprises a concave surface on its radially outside surface.

10. The fan assembly as recited in claim 6 wherein each of said stator vanes is swept in a predetermined direction that is the same as the direction of rotation of said fan.

11. The fan assembly as recited in claim 6 wherein each of said plurality of stator vanes comprises a longitudinal cross-section and a width-wise cross-section;

said longitudinal cross-section defining a longitudinal radius of curvature that is larger than a width-wise radius of curvature of said width-wise cross section, said longitudinal radius of curvature being in a different direction than said width-wise radius of curvature.

* * * * *